US010605515B2

(12) United States Patent
Stanford et al.

(10) Patent No.: US 10,605,515 B2
(45) Date of Patent: Mar. 31, 2020

(54) FOOT ASSEMBLIES

(71) Applicant: LIFETIME PRODUCTS, INC., Clearfield, UT (US)

(72) Inventors: Carl R. Stanford, Clearfield, UT (US); Robert A. Astle, Kaysville, UT (US); Gary Phillips, Clearfield, UT (US)

(73) Assignee: Lifetime Products, Inc., Clearfield, UT (US)

( * ) Notice: Subject to any disclaimer, the term of this patent is extended or adjusted under 35 U.S.C. 154(b) by 129 days.

(21) Appl. No.: 15/885,657

(22) Filed: Jan. 31, 2018

(65) Prior Publication Data

US 2019/0234671 A1 Aug. 1, 2019

(51) Int. Cl.

| | |
|---|---|
| ***F25D 3/08*** | (2006.01) |
| ***B65D 81/38*** | (2006.01) |
| ***F25D 23/08*** | (2006.01) |
| ***B65D 43/16*** | (2006.01) |
| ***F25D 23/06*** | (2006.01) |
| ***B65D 25/28*** | (2006.01) |

(52) U.S. Cl.

CPC ..... *F25D 3/08* (2013.01); *B65D 25/2841* (2013.01); *B65D 43/164* (2013.01); *B65D 81/3816* (2013.01); *F25D 23/065* (2013.01); *F25D 23/08* (2013.01)

(58) Field of Classification Search

CPC ..... F25D 3/08; F25D 23/065; F25D 23/08; B65D 25/2841; B65D 81/3816; B65D 43/164

USPC ..... 220/592.25

See application file for complete search history.

(56) References Cited

U.S. PATENT DOCUMENTS

| | | | | |
|---|---|---|---|---|
| 5,373,708 | A * | 12/1994 | Dumoulin, Jr. | A45C 5/146 280/30 |
| D429,606 | S | 8/2000 | Israel | |
| D429,966 | S | 8/2000 | Israel | |
| D451,765 | S | 12/2001 | Israel | |
| D545,633 | S | 7/2007 | Hussaini | |
| D566,479 | S | 4/2008 | Kabalin | |
| 7,854,321 | B2 * | 12/2010 | Twig | B25H 3/023 206/372 |
| D652,262 | S | 1/2012 | Yang | |
| 8,356,712 | B2 | 1/2013 | Piazza, Jr. | |

(Continued)

OTHER PUBLICATIONS

U.S. Appl. No. 29/602,023, filed Apr. 24, 2017, Stanford, et al.

(Continued)

*Primary Examiner* — Kareen K Thomas

(74) *Attorney, Agent, or Firm* — Maschoff Brennan

(57) ABSTRACT

A foot assembly includes a block retainer and a non-skid block. The block retainer is configured to be positioned at least proximate to an edge between a bottom surface and a side surface of a structure. The block retainer includes a planar portion, an angled portion, and a front surface. The planar portion has an interior surface configured to contact the bottom surface. The angled portion is diposed at an angle from the planar portion and includes an interior surface configured to contact an angled contact surface of the structure. The front surface includes a first dynamic coefficient of friction (DCOF). The non-skid block is connected to the planar portion and includes an exterior portion extending from the front surface away from the structure and includes a second DCOF greater than the first DCOF.

20 Claims, 22 Drawing Sheets

(56) References Cited

U.S. PATENT DOCUMENTS

| | | | | |
|---|---|---|---|---|
| D712,720 | S | 9/2014 | Seiders | |
| D712,721 | S | 9/2014 | Seiders | |
| D712,722 | S | 9/2014 | Seiders | |
| D712,723 | S | 9/2014 | Seiders | |
| D714,125 | S | 9/2014 | Seiders | |
| 8,910,819 | B2 | 12/2014 | Seiders | |
| 8,925,752 | B2 * | 1/2015 | Smith | F25D 3/08 220/23.4 |
| D722,474 | S | 2/2015 | Seiders | |
| D722,475 | S | 2/2015 | Seiders | |
| 9,199,657 | B2 * | 12/2015 | Martin | B62B 5/0083 |
| 9,694,521 | B2 | 7/2017 | French et al. | |
| D806,483 | S | 1/2018 | Stanford et al. | |
| 9,878,841 | B2 * | 1/2018 | Holderness | B67D 3/0067 |
| 10,138,047 | B2 * | 11/2018 | Seiders | B65D 25/2808 |
| 2013/0062356 | A1 * | 3/2013 | Deka | B65D 81/3823 220/592.25 |
| 2018/0015938 | A1 * | 1/2018 | DeFrancia | A45C 13/02 |
| 2018/0038624 | A1 * | 2/2018 | Huish | F25D 3/08 |

OTHER PUBLICATIONS

Notice of Allowance from U.S. Appl. No. 29/585,896 dated Oct. 18, 2017.

U.S. Appl. No. 29/635,579, filed Jan. 31, 2018, Stanford et al.

* cited by examiner

FOOT ASSEMBLIES

BACKGROUND OF THE INVENTION

Field of the Invention

This application is generally directed towards foot assemblies and, in particular, to foot assemblies for coolers.

Description of Related Art

Coolers are widely used to maintain temperature and to limit thermal transfer between an environment and material while the material is being stored or transported. Generally, coolers include a volume into which the materials are placed. The cooler may include one or more thermally insulative materials that surround or substantially surround the volume. The thermally insulative materials reduce thermal transfer to the materials from the environment. Additionally, the cooler may reduce mass transfer between the environment and the volume, which may further reduce thermal transfer to the volume.

Coolers take various forms. For instance, some coolers are sized to store six—355 milliliter (mL) beverage cans while others are sized to store tens or hundreds of liters of materials. A relatively common size for a cooler may define a volume of about 50 liters (L). The 50 L coolers provides a relatively large usable volume for storage. The relatively large size, however, may require large amounts of insulative materials and may enable placement of large amounts of products to be placed within the volume defined by the cooler. The large amounts of insulative materials may increase the weight of the cooler. Additionally, during use, the products placed in the volume defined by the cooler may further increase the weight of the cooler. As the weight increases, the difficulty associated with movement of the cooler also increases. For instance, 50 L of water may have a mass of about 50 kilograms (kg). Moving a cooler weighing over 50 kg may be difficult for some users.

The subject matter claimed herein is not limited to embodiments that solve any disadvantages or that operate only in environments such as those described above. Rather, this background is only provided to illustrate one exemplary technology area where some embodiments described herein may be practiced

BRIEF SUMMARY OF EMBODIMENTS OF THE INVENTION

A need therefore exists for a foot assembly and cooler that eliminates the above-described disadvantages and problems.

An aspect of an embodiment may include a foot assembly that may be configured to support a structure relative to a surface. The foot assembly may include a block retainer and a non-skid block. The block retainer may be configured to be positioned at least proximate to an edge between a bottom surface of a structure and a side surface of the structure. The block retainer may include a planar portion, an angled portion, and a front surface. The planar portion may have an interior surface that may be configured to contact the bottom surface. The angled portion may be disposed at an angle to the planar portion. The angle at which the angled portion is disposed relative to the planar portion may be between 90 degrees and 180 degrees, between 120 degrees to 160 degrees, or between 135 degrees and 145 degrees. The angled portion may include an interior surface that may be configured to contact an angled contact surface of the structure, such as an angled contact surface between the bottom surface and the side surface. The front surface, which may be opposite the interior surface, may include a first dynamic coefficient of friction (DCOF). The non-skid block may be retained in or connected to the planar portion. The non-skid block may include an exterior portion that extends from the front surface in a direction away from the structure and includes a second DCOF that may be greater than the first DCOF. The foot assembly may enable the structure to be configured in a first orientation and in a second orientation relative to a surface such as a floor, ground, support surface, or the like. In the first orientation, the planar portion may be positioned substantially parallel to the surface and the non-skid block may contact the surface such that a frictional resistance to translation relative to the surface may be based on the second DCOF. In the second orientation, the front surface of the angled portion may contact the surface such that the frictional resistance to the translation relative to the surface may be based on the first DCOF. The foot assembly may include a fastener housing. The fastener housing may include one or more fastener openings and the fastener openings may be configured to receive a fastener that attaches the block retainer to the structure. The fastener housing may include an elongated portion that protrudes substantially normal to the planar portion. The elongated portion may be configured to be received into a fastener housing receiver at least partially defined in the bottom surface of the structure. The block retainer may include an outer edge at least a portion of which may be configured to be aligned with an outer edge of the bottom surface of the structure. The block retainer may define a block opening in which the non-skid block may be retained relative to or otherwise connected to the block retainer. The block retainer may include one or more ribs that extend from the outer edge to the fastener housing and between the outer edge to an inner perimeter that extends around at least a portion of the block opening. The interior surface of the planar portion may be defined on a surface of the one or more ribs. The non-skid block may include an external portion that extends above the front surface of the planar portion when positioned in the block opening and an inner block structure that may be configured to be received in the block opening.

Another aspect of an embodiment may include a cooler with a structure and a foot assembly. The structure may include a tub portion, which may be constructed from blow-molded plastic. In particular, the tub portion may be integrally formed as part of a unitary, one-piece structure. For example, the tub portion may include an exterior layer that is constructed from a single wall blow-molded plastic piece. It will be appreciated, after reviewing this discloses, that the tub portion may also be constructed from a double wall blow-molded plastic pieces. The foot assembly that may be configured to support a structure relative to a surface. The foot assembly may include a block retainer and a non-skid block. The block retainer may be configured to be positioned at least proximate an edge between a bottom surface of the structure and a side surface of the structure. The block retainer may include a planar portion, an angled portion, and a front surface. The planar portion may have an interior surface that may be configured to contact the bottom surface. The angled portion may extend at an angle from the planar portion. The angled portion may include an interior surface that may be configured to contact an angled contact surface of the structure that may be positioned at least proximate the edge between the bottom surface on the side surface. The front surface may include a first DCOF and may be opposite the interior surfaces. The non-skid block may be retained in or otherwise connected to the planar portion. The non-skid block may include an exterior portion that extends from the front surface in a direction away from the structure and may include a second DCOF that may be greater than the first DCOF.

A further aspect of an embodiment may include a cooler with a tub portion and a foot assembly. The tub portion that may include a bottom portion that may be connected to a side portion via an angled contact surface. The foot assembly may be positioned at least partially on the bottom portion and at least partially on the angled contact surface. The foot assembly may include a planar portion that may be positioned on the bottom portion. The foot assembly may include a non-skid block having a first DCOF and an angled portion that may be positioned on the angled contact surface that has a second DCOF greater than the first DCOF. The cooler may be configurable in a first orientation in which the planar portion may be positioned substantially parallel to a surface such that the non-skid block contacts the surface to increase frictional resistance to translation of the cooler relative to the surface. The cooler may be configurable in a second orientation in which the angled portion may be in contact with the surface to reduce frictional resistance to the translation of the cooler relative to the surface. The tub portion may include an exterior layer and an interior layer that that may be positioned within the exterior layer. An exterior cavity may be defined between the exterior layer and the interior layer. An insulative material such as foam or insulative foam may be disposed in the exterior cavity. The exterior layer may constructed from a single wall or double wall portion of blow-molded plastic structure. The blow-molded plastic structure may include the bottom portion, the side portion, a top surface, a front portion, a rear portion, and another side portion. The top surface may include a lip that extends substantially normal to an interior perimeter of the top surface. The top surface may define a groove and the interior layer may include a generally ∩-shaped channel that extend around at least a portion of a perimeter of the interior layer that extends over the lip and into the groove. The cooler may include a fastener housing receiver that may be at least partially defined in a bottom surface of the bottom portion. The foot assembly may define a fastener housing that may include an elongated portion that protrudes substantially normal to the planar portion and may define a fastener opening that may be configured to receive a fastener. The fastener housing receiver may be sized such that an outer surface of the fastener housing contacts at least a portion of an inner surface of the fastener housing receiver when the fastener housing may be received in the fastener housing receiver. The planar portion and the angled portion may be integrated into a block retainer that may define a block opening in which the non-skid block may be retained.

Yet another aspect of an embodiment may include cooler with a lid, a tub portion, a hinge, four foot assemblies, two handles, a drain subassembly, and a clasp subassembly. The tub portion may include a bottom portion that may be connected to side portions via one or more angled contact surfaces. The tub portion may include an exterior layer, an interior layer that defines an internal volume, and an insulative material, such as foam or an insulative foam, in a cavity disposed between the interior layer and the exterior layer. The hinge may rotatably couple the lid to the tub portion such that the lid may be positionable in an open position relative to the tub portion in which the internal volume may be open to a surrounding environment and a closed position relative to the tub portion in which the internal volume may be substantially enclosed. The four foot assemblies may be positioned at least proximate to corners of the bottom portion and may be aligned with an outer edge of a bottom surface of the bottom portion. Each foot assembly of the four foot assemblies may include a planar portion that may have an interior surface that contacts the bottom surface, an angled portion that extends at an angle from the planar portion and contacts the angled contact surface, and a front surface that may be opposite the interior surfaces and that may include a first DCOF. Each foot assembly may include a non-skid block that may be retained in the planar portion. The non-skid block may include an exterior portion that extends from the front surface in a direction away from the bottom portion and that may include a second DCOF that may be greater than the first DCOF. The cooler may be configurable in a first orientation in which the planar portion may be positioned substantially parallel to a surface such that the non-skid block contacts the surface to increase frictional resistance to translation of the cooler relative to the surface. The cooler may be configurable in a second orientation in which the angled portion may be in contact with the surface to reduce frictional resistance to the translation of the cooler relative to the surface. The cooler may include a fastener housing receiver that may be at least partially defined in the bottom surface of the bottom portion. The foot assembly may define a fastener housing that may include an elongated portion that protrudes substantially normal to the planar portion and that defines a fastener opening that may be configured to receive a fastener. The fastener housing receiver may be sized such that an outer surface of the fastener housing contacts at least a portion of an inner surface of the fastener housing receiver when the fastener housing may be received in the fastener housing receiver. The planar portion may define a block opening in which the non-skid block may be retained. The non-skid block may include an external portion that extends above the front surface of the planar portion when positioned in the block opening and an inner block structure that may be received in the block opening. The block retainer may include an outer edge at least a portion of which may be configured to be aligned with an outer edge of the bottom surface. The block retainer may include one or more ribs that extend from the outer edge to the fastener housing and between the outer edge to an inner perimeter that extends around at least a portion of the block opening. The interior surface of the planar portion may be defined on a surface of the rib. The exterior layer may be single wall or double wall structure that is constructed from blow-molded plastic. The exterior layer may be integrally molded as part of a unitary, one-piece blow-molded plastic structure and it may include the bottom portion, the side portions, a top surface, a front portion, and a rear portion. The top surface may include a lip that extends substantially normal to an interior perimeter of the top surface. The top surface may define a groove and the interior layer may include a generally ∩-shaped channel that extends around at least a portion of a perimeter of the interior layer that extends over the lip and into the groove.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

The appended drawings contain figures of preferred embodiments to further illustrate and clarify the above and other aspects, advantages, and features of the present invention. It will be appreciated that these drawings depict only preferred embodiments of the invention and are not intended to limit its scope. Additionally, it will be appreciated that while the drawings may illustrate preferred sizes, scales, relationships, and configurations of the invention, the drawings are not intended to limit the scope of the claimed invention. The invention will be described and explained with additional specificity and detail through the use of the accompanying drawings in which:

DETAILED DESCRIPTION OF SOME EXEMPLARY EMBODIMENTS

The present invention is generally directed towards foot assemblies that may be implemented in coolers. The principles of the present invention, however, are not limited to the foot assemblies or the coolers explicitly described or depicted. It will be understood that, in light of the present disclosure, the foot assemblies and the coolers disclosed herein may have a variety of shapes, sizes, configurations, and arrangements. It will also be understood that the foot assemblies and the coolers may include any suitable number and combination of features, components, aspects, and the like. In addition, while the foot assemblies and the coolers shown in the accompanying figures are illustrated as having particular styles, it will be appreciated the foot assemblies and the coolers may have any suitable style or configuration.

Additionally, to assist in the description of various exemplary embodiments of the foot assemblies and the coolers, words such as top, bottom, front, rear, sides, right, and left are used to describe the accompanying figures which may be, but are not necessarily, drawn to scale. It will further be appreciated that the foot assemblies and the coolers may be disposed in a variety of desired positions or orientations, and used in numerous locations, environments, and arrangements. A detailed description of exemplary embodiments of the foot assemblies and the coolers now follows.

Figure 1A:
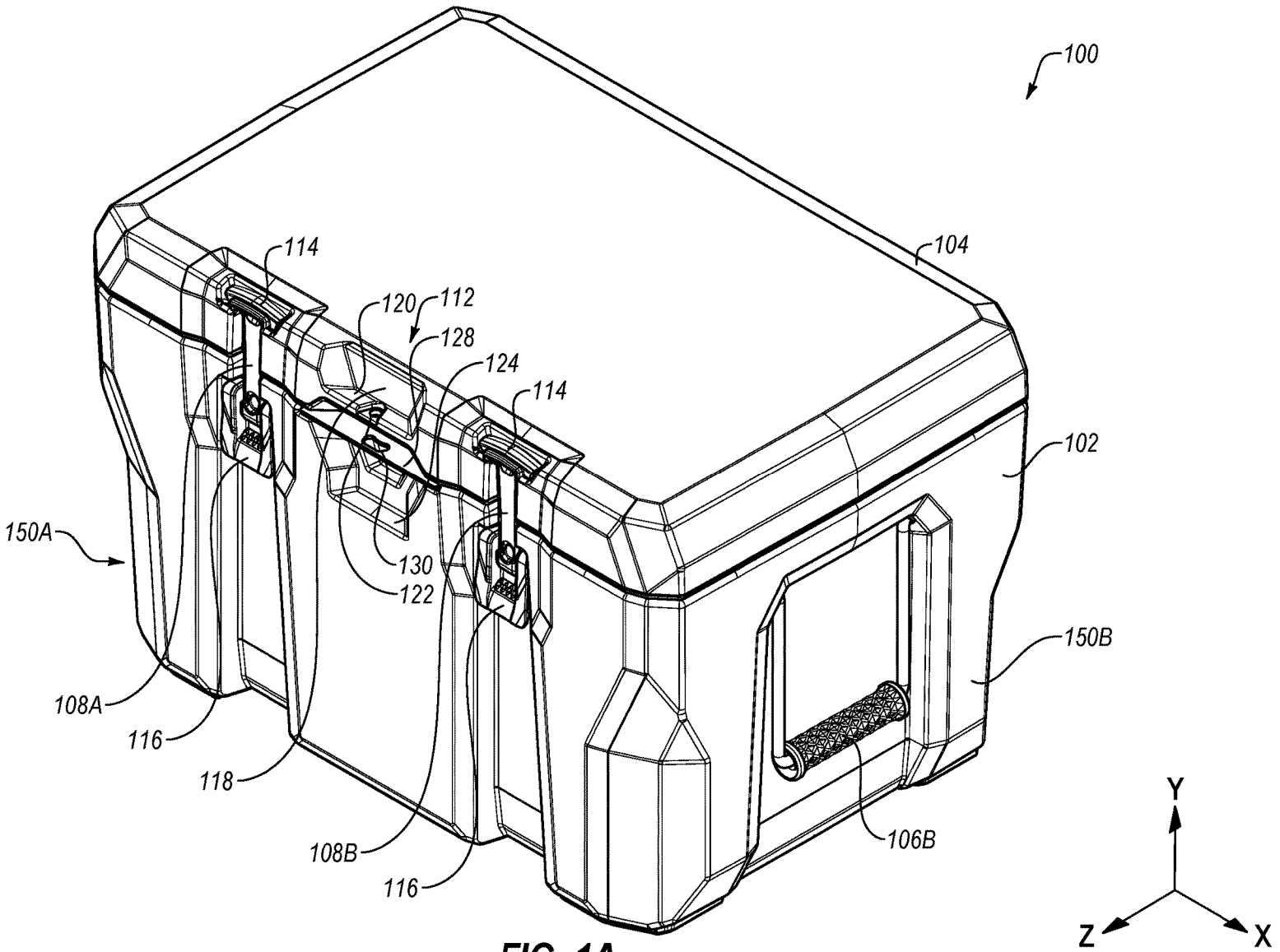
FIG. 1A illustrates an upper perspective view of an exemplary cooler.
Figure 1B:
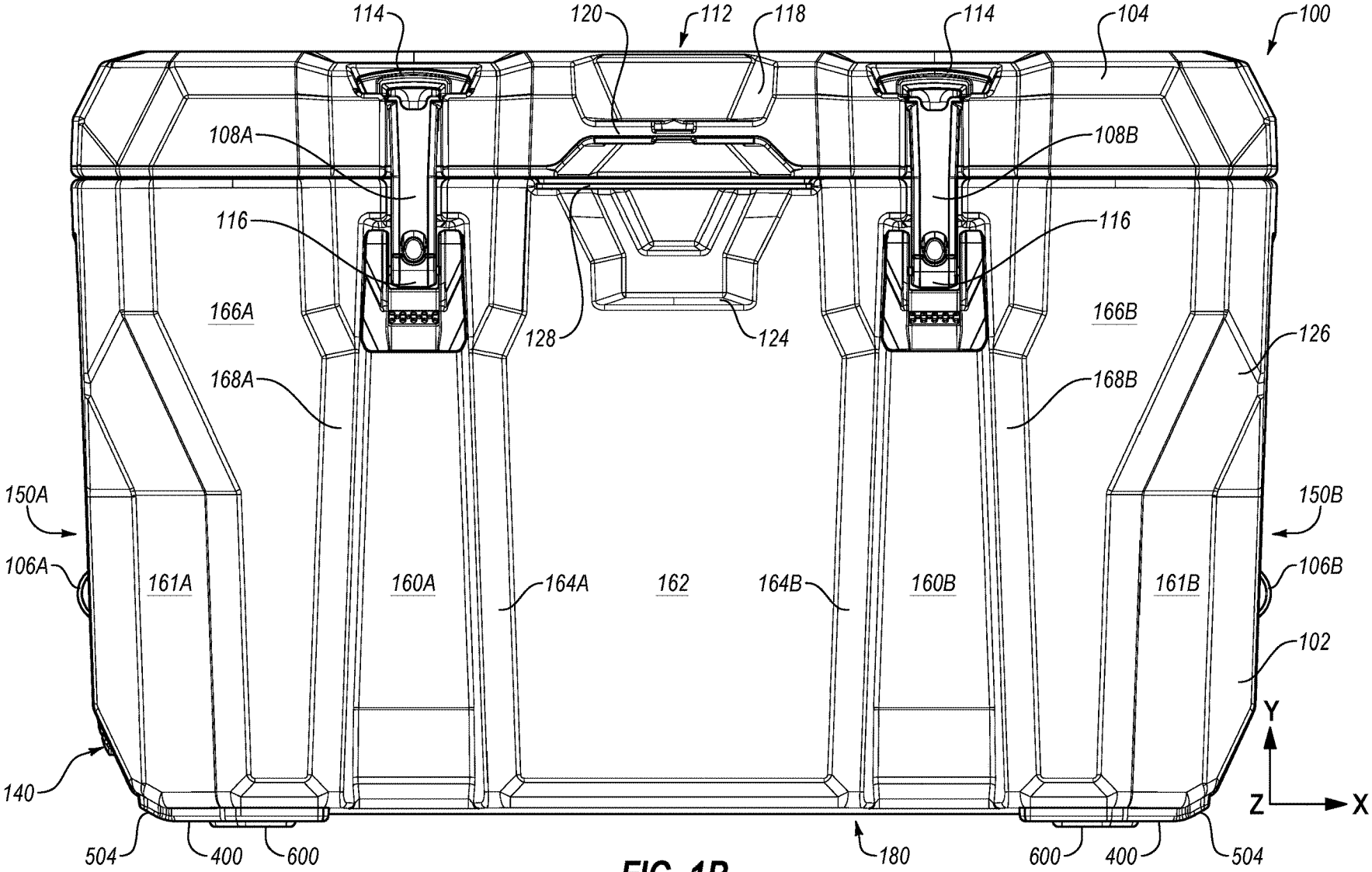
FIG. 1B illustrates a front view of the cooler of FIG. 1A.
Figure 1C:
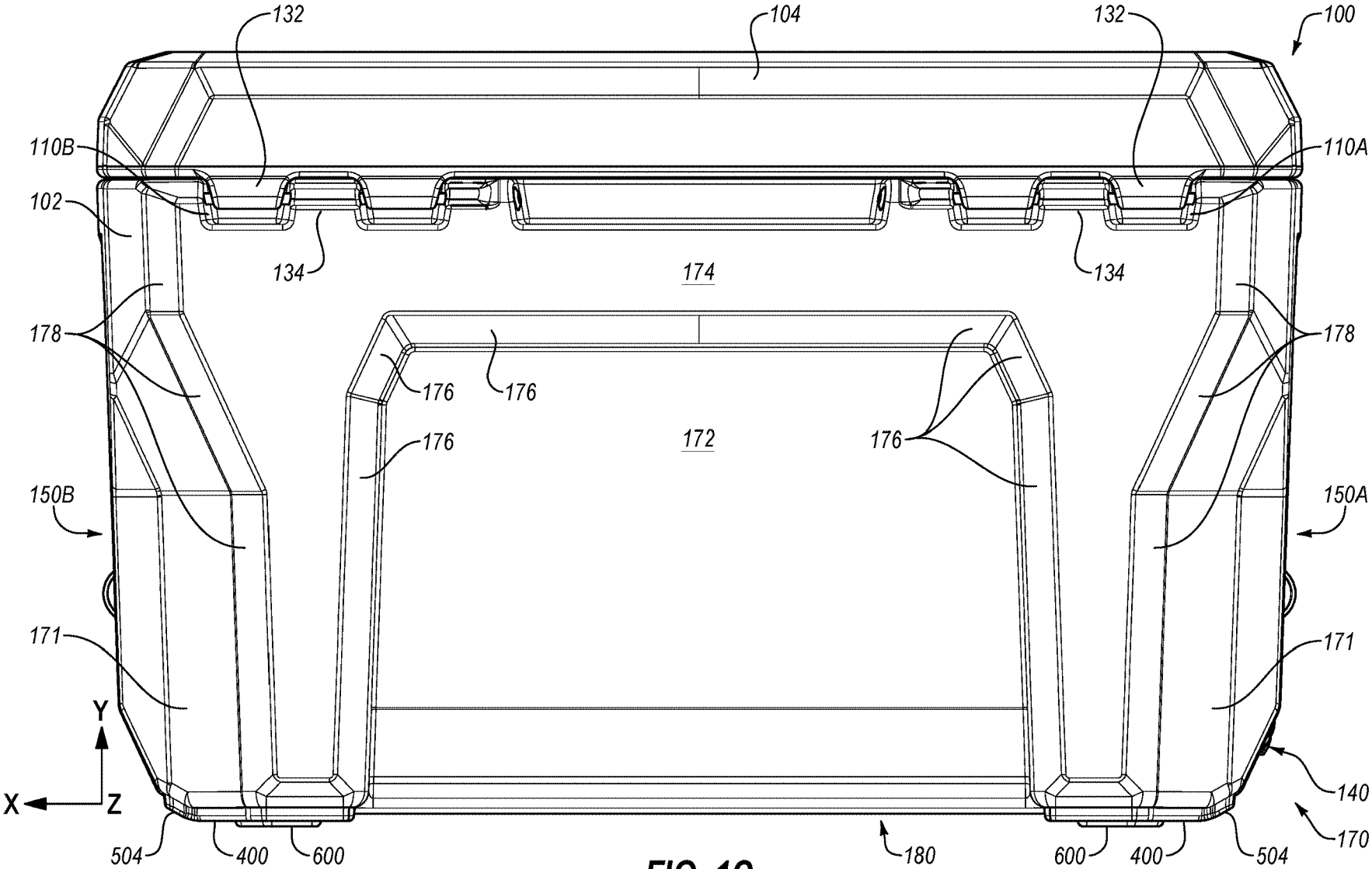
FIG. 1C illustrates a rear view of the cooler of FIG. 1A.
Figure 1D:
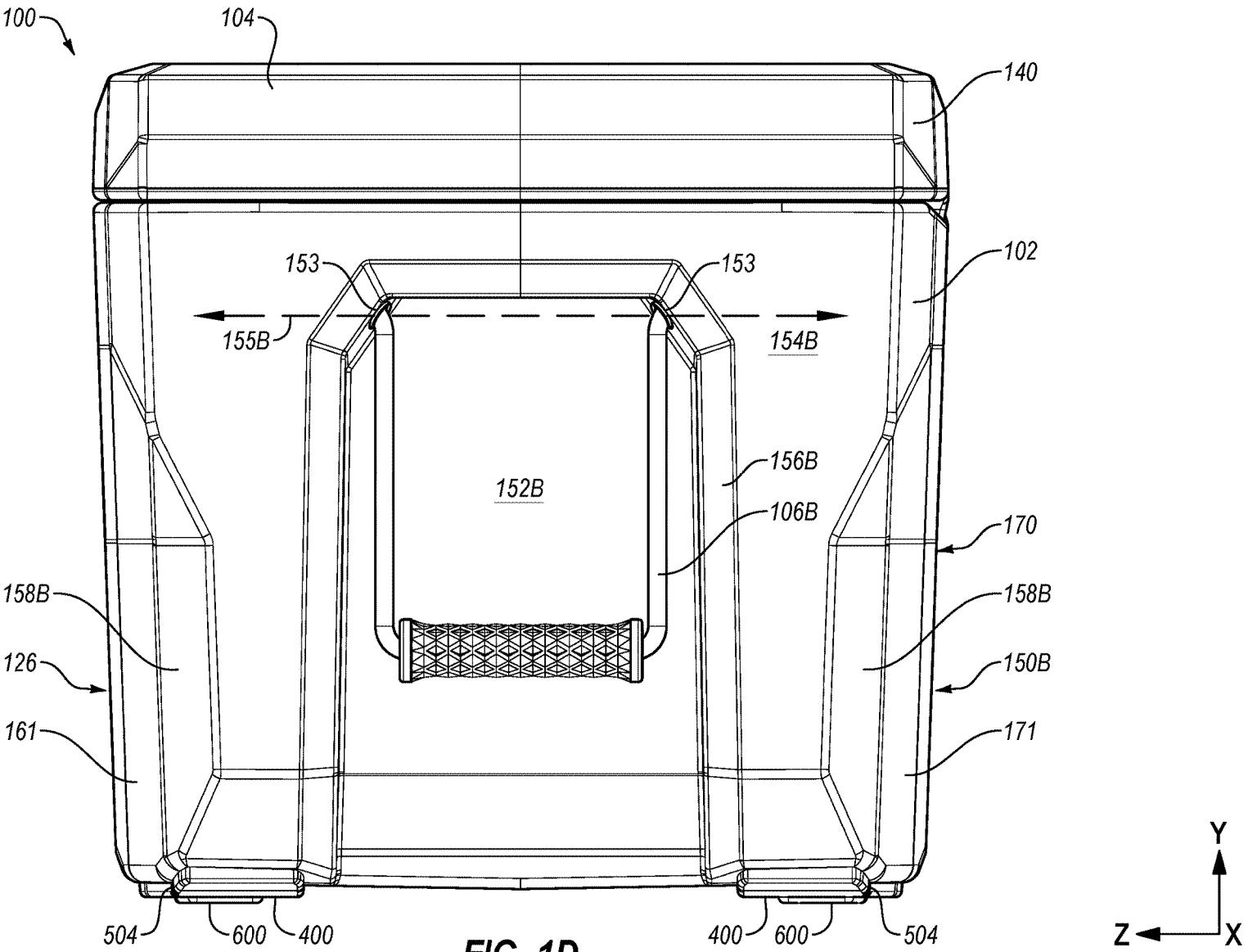
FIG. 1D illustrates a first side view of the cooler of FIG. 1A.
Figure 1E:
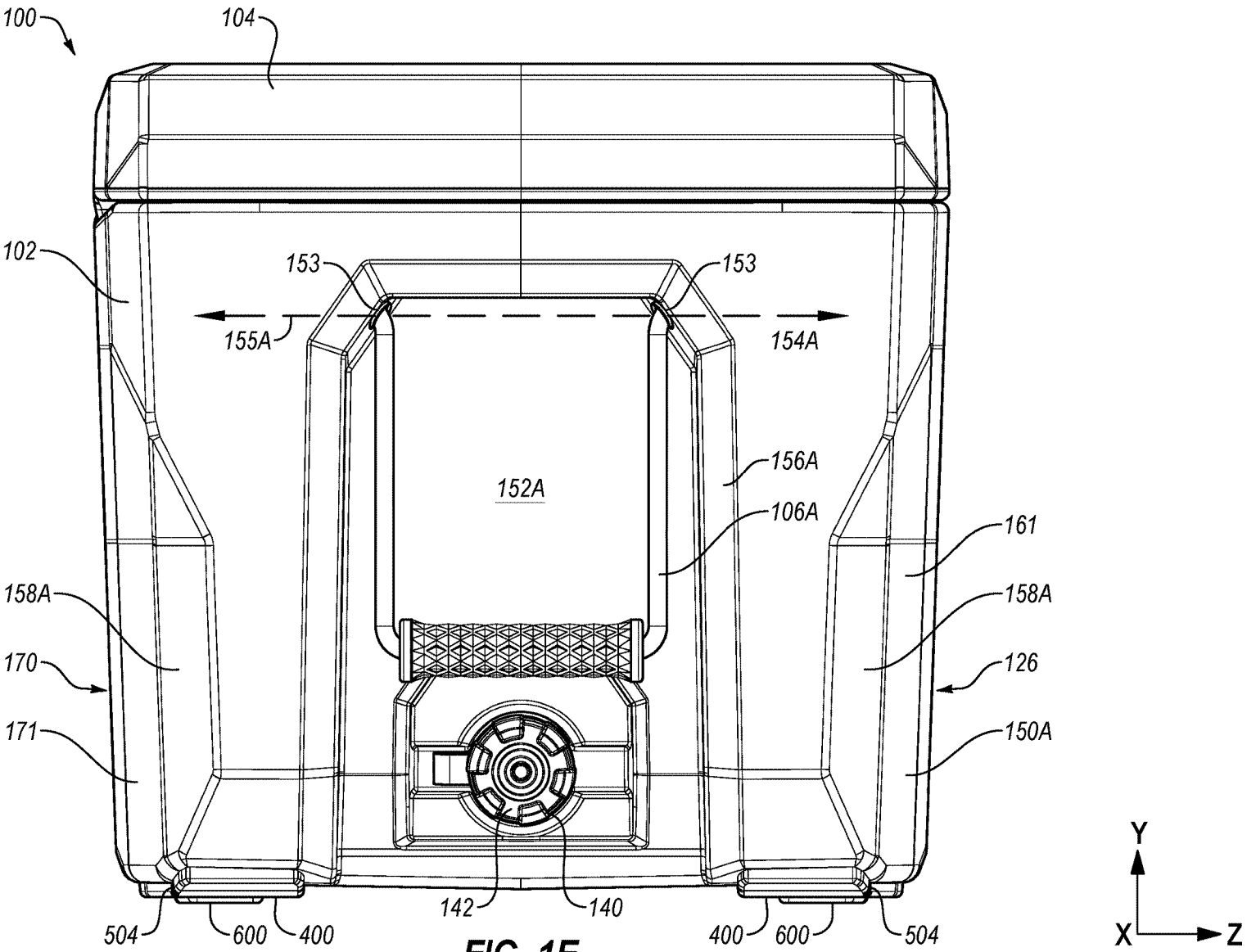
FIG. 1E illustrates a second side view of the cooler of FIG. 1A.
Figure 1F:
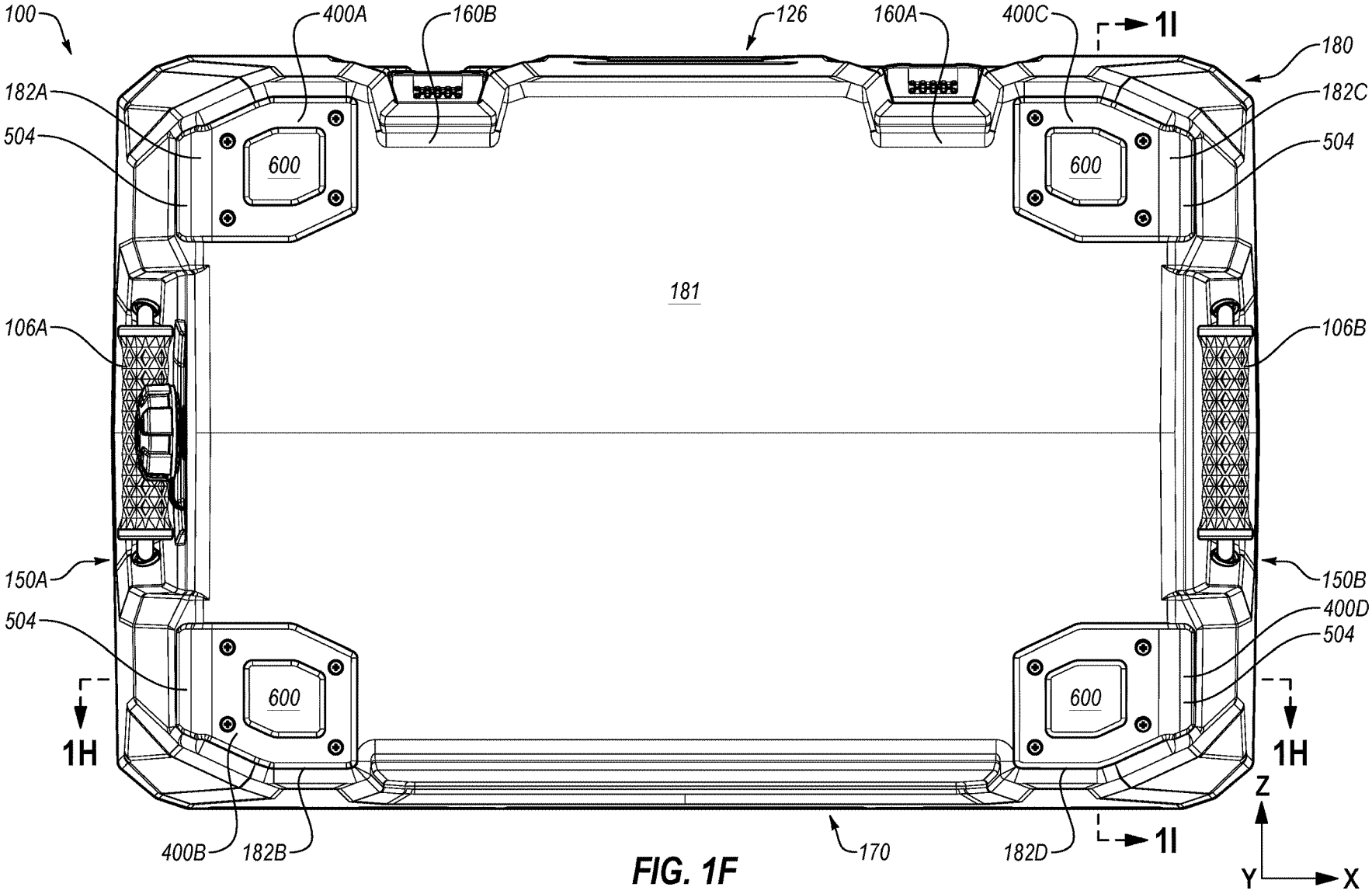
FIG. 1F illustrates a bottom view of the cooler of FIG. 1A.
Figure 1G:
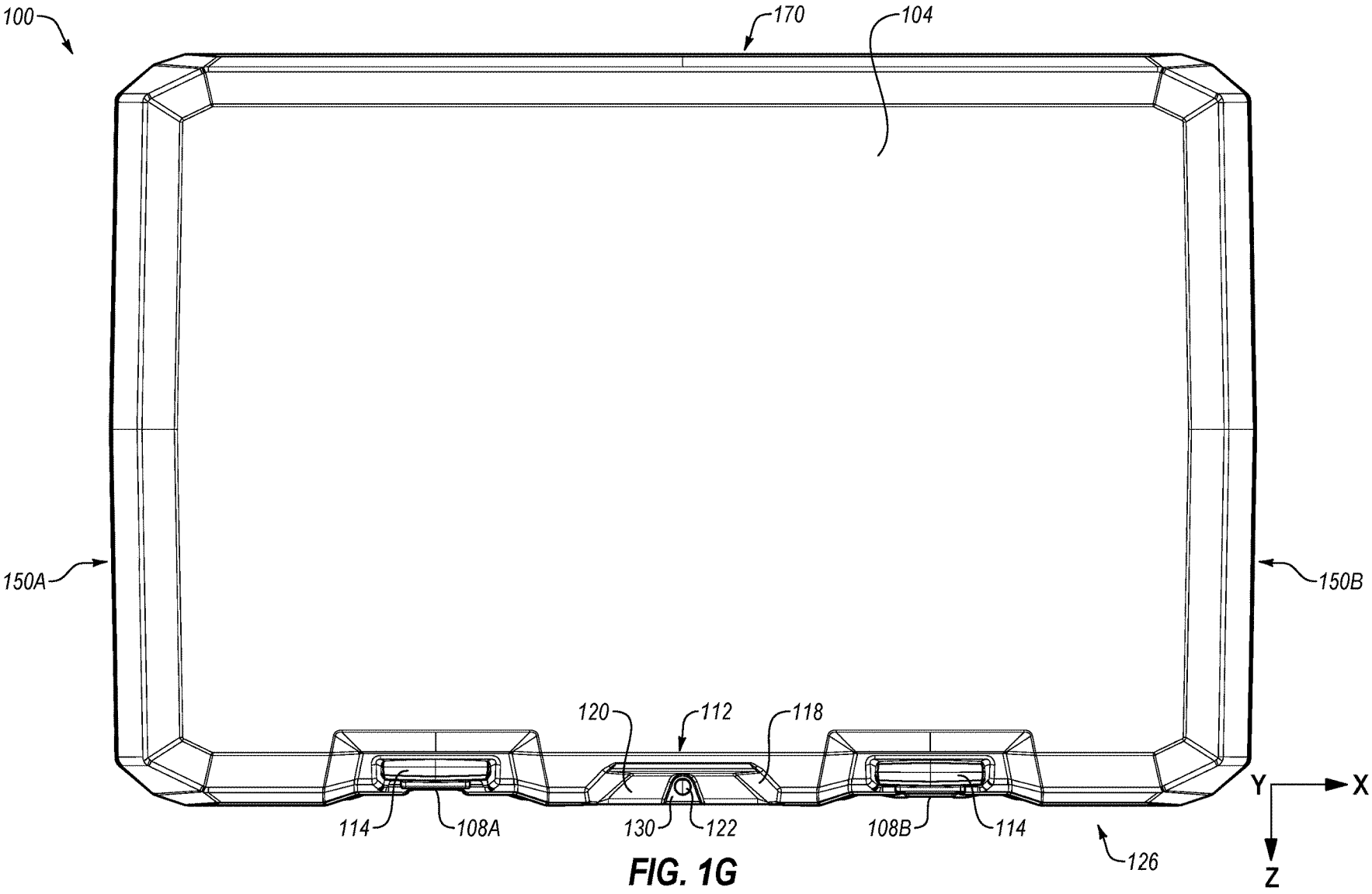
FIG. 1G illustrates a top view of the cooler of FIG. 1A.

FIGS. 1A-1G illustrate an exemplary cooler 100 according to at least one exemplary embodiment. FIG. 1A depicts an upper perspective view of the cooler 100. FIG. 1B depicts a front view of the cooler 100. FIG. 1C depicts a rear view of the cooler 100. FIG. 1D depicts a first side view of the cooler 100. FIG. 1E depicts a second side view of the cooler 100. FIG. 1F depicts a bottom view of the cooler 100. FIG. 1G depicts a top view of the cooler 100. The cooler 100 may reduce thermal transfer from the environment that surrounds the cooler 100 to a volume defined within the cooler 100. In particular, the cooler 100 of FIGS. 1A-1G may be implemented to insulate materials (e.g., food, drink, medical equipment, medicine, other perishables, cold packs, etc.) that are placed or positioned within the cooler 100 from environmental conditions.

The cooler 100 may be configured to be selectively portable or movable. For instance, the cooler 100 may be configured to be moved by one or more users from one place to another place. In some circumstances, one or more users may carry the cooler 100. For example, the cooler 100 may include one or more handles, such as handles 106A and 106B (generally, handle 106 or handles 106) that may be attached to side portions 150A and 150B of the cooler 100. The handles 106 may be rotated relative to a tub portion 102 such that the user(s) may lift the cooler 100. Between movements of the cooler 100, it may be advantageous for the cooler 100 to be resistant to translation or sliding. In particular, it may be advantageous for the cooler 100 to maintain its position relative to a surface such as a floor, support surface, a floor of a vehicle, etc. on which it is placed.

Accordingly, in some embodiments, the cooler 100 may include one or more foot assemblies, such as foot assemblies 400A-400D (generally, foot assembly 400 or foot assemblies 400), some subset of which are visible in FIGS. 1B-1F. The foot assemblies 400 may include a non-skid block 600. When the cooler 100 is placed on a surface, the non-skid block 600 may contact the surface. The non-skid block 600 may include a dynamic coefficient of friction (DCOF) that is sufficient to prevent inadvertent translation of the cooler 100 relative to the surface. For instance, the DCOF may be greater than about 0.3, greater than about 0.43, greater than about 0.5 or another suitable DCOF. Thus, when the cooler 100 is placed on the surface, a force necessary to translate the cooler 100 may be greater than other coolers that do not include the non-skid blocks 600.

Additionally, in some circumstances, the foot assemblies 400 may include angled portions 504, which are described in detail below. The cooler 100 may be oriented such that the angled portions 504 contact a surface such as a floor, ground, a floor of a vehicle, etc. For instance, one of the handles 106 may be used to lift a portion of the cooler 100 such that the angled portion 504 on an opposite side of the cooler 100 contacts the surface. The angled portions 504 may have a lower DCOF. Thus, the cooler 100 may be translated relative to the surface. The user may accordingly lift a portion of the cooler 100 such that it is angled relative to the surface. The user may then drag the cooler 100, with the angled portions 504 remaining in contact with the surface.

In addition to the foot assemblies 400, the handles 106, and the tub portion 102; the cooler 100 may include components such as a lid 104, latches 108A and 108B, hinges 110A and 110B, a drain subassembly 140, and a clasp subassembly 112. The foot assemblies 400, the handles 106, the tub portion 102, the lid 104, the latches 108A and 108B (generally, latch 108 or latches 108), the hinges 110A and 110B (generally, hinge 110 and hinges 110), the drain subassembly 140, and the clasp subassembly 112 are referred to collectively as cooler components. Each of the cooler components are described below.

With reference to FIGS. 1A, 1B, and 1G, the cooler 100 may include one or more latches 108. The latches 108 may be configured to secure the lid 104 to the tub portion 102 when the lid 104 is in a closed position (as depicted in FIGS. 1A-1G). The latches 108 may be secured to the tub portion 102 and may include a hook portion 114 that extends in the y-direction from the tub portion 102. The hook portion 114 may be configured to engage with recess in the lid 104. The latches 108 may include a lower portion 116 (FIGS. 1A and 1B) that moves relative to hook portion 114. The lower portion 116 may draw the hook portion 114 in a negative y-direction, which may engage the hook portion with the lid 104.

In the embodiment of FIGS. 1A, 1B, and 1G, the cooler 100 includes two latches 108. In other embodiments, the cooler 100 may include a single latch 108 or three or more latches 108. Additionally or alternatively, the latches 108 may include a different structure. For instance, the hook portion 114 may extend in a negative y-direction and the lower portion 116 may be attached to the lid 104.

With continued reference to FIGS. 1A, 1B, and 1G, the clasp subassembly 112 may include a first recess 118 formed at least partially in the lid 104. A first lateral element 120 may extend across a lower portion of the first recess 118. A first opening 122 may be defined in the first lateral element 120. The clasp subassembly 112 may include a second recess 124 (FIGS. 1A and 1B) defined in a front portion 126 of the tub portion 102. A second lateral element 128 (FIGS. 1A and 1B) may extend along an upper portion of the second recess 124. The second lateral element 128 may define a second opening 130. When the lid 104 is in a closed position, the first opening 122 may be positioned relative to the second opening 130 such that the first opening 122 overlaps at least a portion of the second opening 130 as visible in FIG. 1G. Accordingly, a cylinder (e.g., a portion of a lock) may be positioned concurrently in the first opening 122 and in the second opening 130.

In some embodiments, the first lateral element 120 may be integrally formed in the lid 104. For example, as described below, the lid 104 may be constructed using an injection molding process. During the injection molding process, the first lateral element 120 may be formed. In these and other embodiments, the second lateral element 128 may be metal or another suitable rigid material. The second lateral element 128 may be introduced to the tub portion 102 following construction of the tub portion 102.

Additionally, in some embodiments, the second opening 130 may be configured as a bottle opener. For instance, the second opening 130 may include a crescent cross-section or a tab that is sized to be placed under a bottle cap. The bottle may be rotated relative to the tub portion 102, which may disengage the bottle cap from the bottle.

Figure 2A:
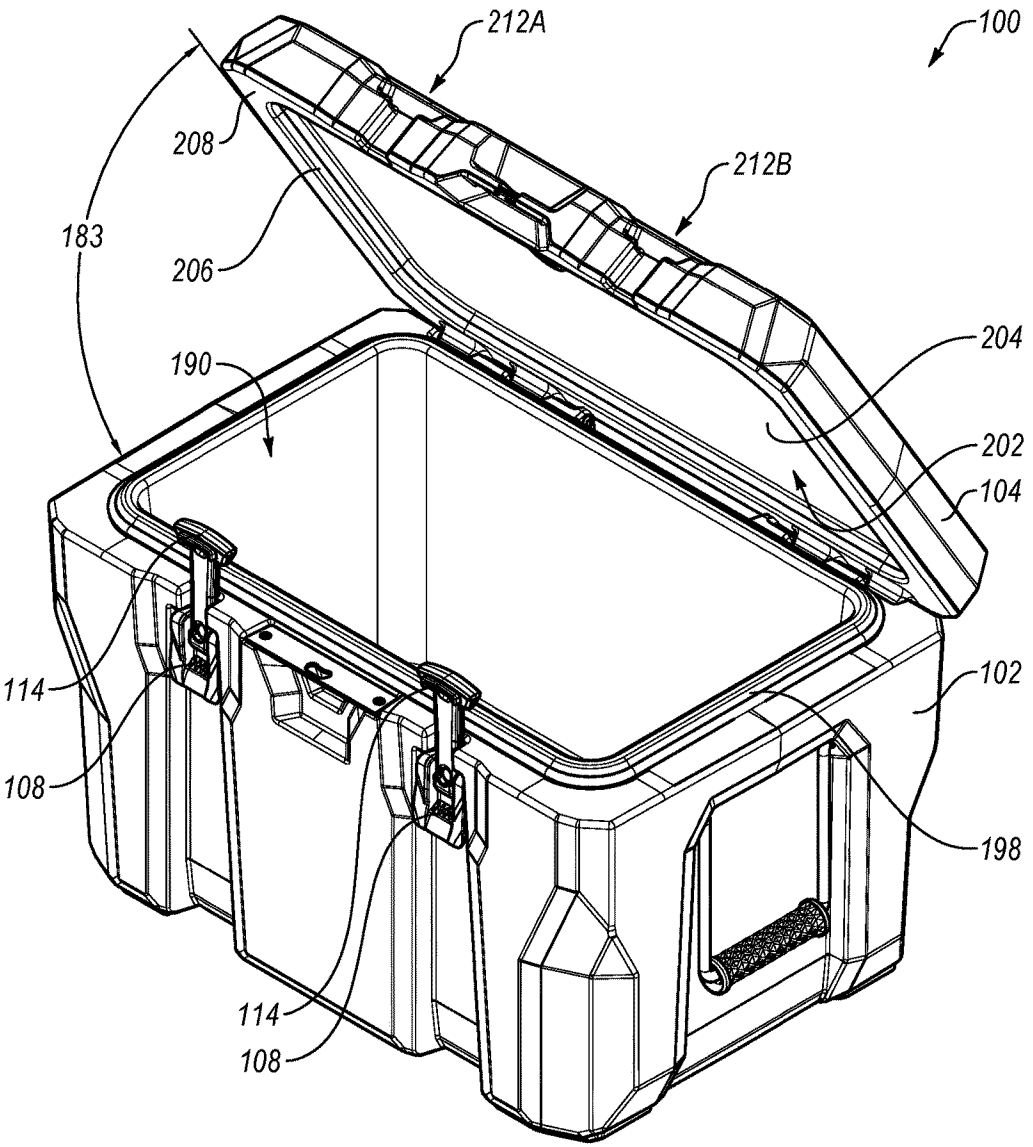
FIG. 2A illustrates a perspective view of the cooler of FIG. 1A with an exemplary lid in an open position.
Figure 2B:
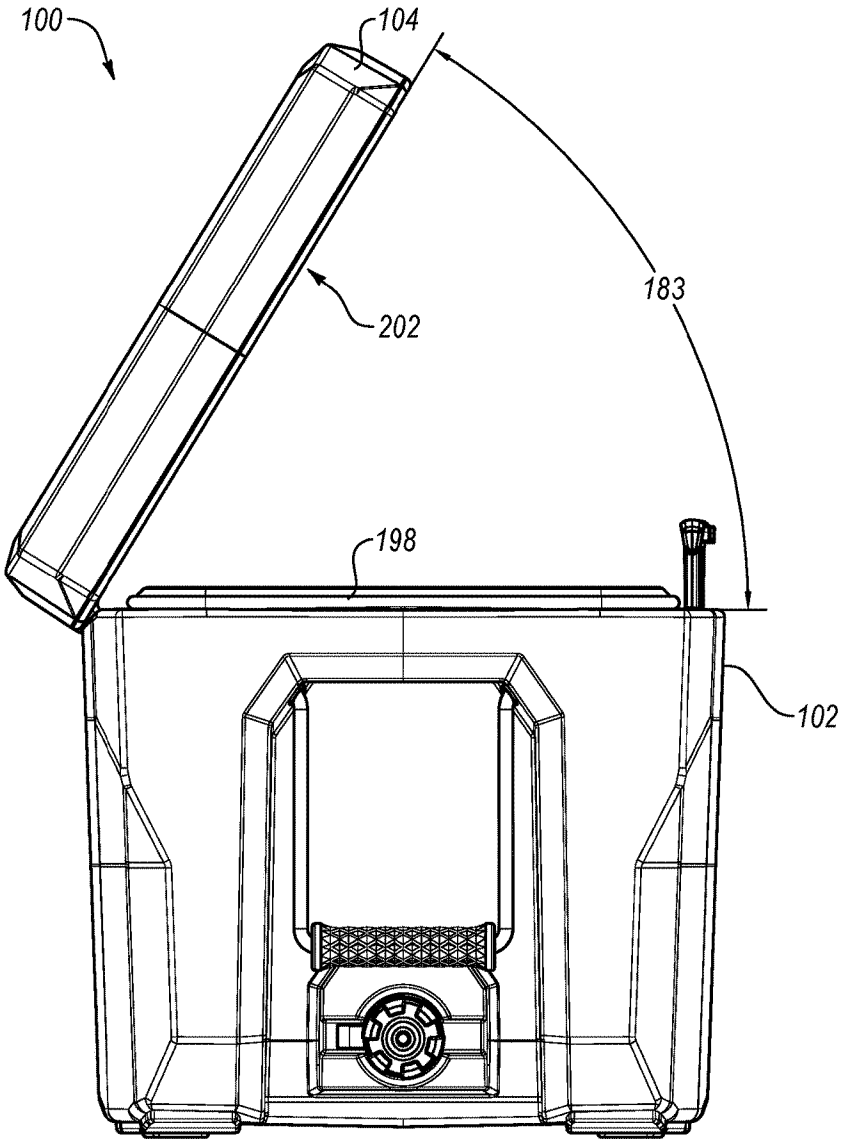
FIG. 2B illustrates a side view of the cooler in the configuration of FIG. 2A.
Figure 2C:
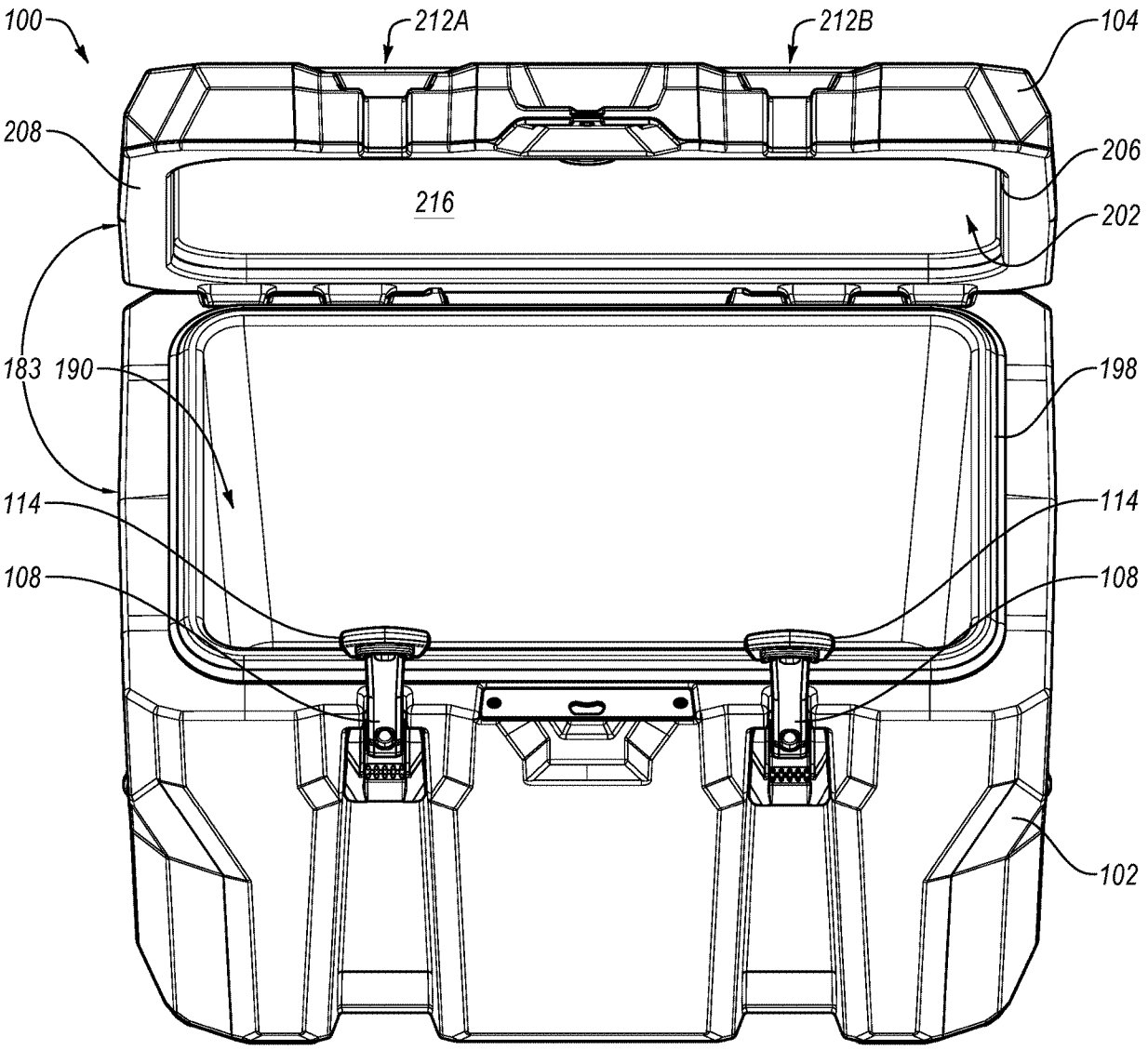
FIG. 2C illustrates another perspective view of the cooler in the configuration of FIG. 2A

With reference to FIG. 1C, the cooler 100 may include one or more hinges 110. In the embodiment of FIG. 1C, a first leaf 132 of the hinges 110 may be integrally formed in the lid 104. Additionally, a second leaf 134 of the hinges 110 may be integrally formed in the tub portion 102. A pin (not shown in FIG. 1C) may be positioned in the first leaf 132 and the second leaf 134. The first leaf 132 may rotate about the pin relative to the second leaf 134. Accordingly, the hinges 110 may enable rotation of the lid 104 relative to the tub portion 102 about the pin. Such rotation enables positioning of the lid 104 in an open position as depicted in FIGS. 2A-2C and a closed position as depicted in FIGS. 1A-1G.

With reference to FIG. 1E, the drain subassembly 140 may be positioned on a first side portion 150A of the tub portion 102. The drain subassembly 140 may include a channel. The channel may extends from an environment surrounding the cooler 100 into a volume defined within the cooler 100. In particular, the channel may extend through the side portion 150A of the tub portion 102. The drain subassembly 140 may include a cap 142. The cap 142 may selectively seal the channel. The cap 142 may be include a threaded coupling. In the depicted embodiment, the drain subassembly 140 is positioned on the side portion 150A. In other embodiments, the drain subassembly 140 may be positioned on another portion of the tub portion 102 such as a front portion 126, a rear portion 170, or the other side portion 150B. Additionally or alternatively, the cooler 100 may include two or more drain subassemblies 140. In some embodiments, the threads of the threaded portion may be selected to interface with another system. For instance, the threads may be configured to interface with hose threads of a residential irrigation system.

External views of the tub portion 102 are depicted in FIGS. 1A-1F. In particular, FIG. 1A depicts a perspective view of the front portion 126 and the side portion 150B of the tub portion 102. FIG. 1B depicts the front portion 126. FIG. 1C depicts a rear portion 170. FIGS. 1D and 1E depict the sides portions 150A and 150B. FIG. 1F depicts a bottom portion 180.

FIG. 1B depicts an external view of the front portion 126 of the tub portion 102. As described above, the front portion 126 may include or retain the latches 108 and the clasp subassembly 112. In addition, the front portion 126 may define two latch channels 160A and 160B. The latches 108 may be disposed in the latch channels 160A and 160B. The latch channels 160A and 160B may be separated by a central surface 162. The second recess 124 may be defined in the central surface 162.

The central surface 162 may be connected to the latch channels 160A and 160B by inner sloped surfaces 164A and 164B. The front portion 126 may also include outer sloped surfaces 166A and 166B that are connected to the latch channels 160A and 160B may outer sloped surfaces 168A and 168B. Corner surfaces 161A and 161B may be connected to the outer sloped surfaces 166A and 166B. Additionally, the corner surfaces 161A and 161B may connect to and/or make up a part of the side portions 150A or 150B.

The latch channels 160A and 160B may enable the latches 108 or the lower portions 116 thereof to be recessed relative to the central surface 162 and the outer sloped surfaces 166A and 166B. Accordingly, when the latches 108 are in a configuration to retain the lid 104 relative to the tub portion 102, the lower portions 116 may not extend past the central surface and the outer sloped surfaces 166A and 166B. Such positioning may reduce the likelihood that the lower portions 116 are hit, bumped, or otherwise contacted, which may reduce the likelihood that the latches 108 are disengaged from the lid 104.

In addition, the latch channels 160A and 160B, the outer sloped surfaces 166A and 166B, and the central surface 162 may provide or improve structural rigidity of the front portion 126. Additionally, the latch channels 160A and 160B, the outer sloped surfaces 166A and 166B, and the central surface 162 may at least partially define a volume that is immediately internal to the front portion 126. The volume may be filled with an insulative material, such as foam or an insulative foam, as described elsewhere in the present disclosure. The latch channels 160A and 160B, the outer sloped surfaces 166A and 166B, and the central surface 162 may vary and define thicknesses of the insulative foam. In FIG. 1B, a subset of the foot assemblies 400 are visible. The foot assemblies 400 are positioned on the bottom portion 180, which is described below with reference to FIG. 1F. As shown in FIG. 1B, the foot assemblies 400 extend in a negative y direction from the bottom portion 180.

FIG. 1C depicts an external view of the rear portion 170 of the tub portion 102. As described above, the rear portion 170 may include second leaves 134 of the hinges 110. Additionally, the rear portion 170 may include one or more surfaces. For example, in the embodiment of FIG. 1C, the rear portion 170 includes a central surface 172. The central surface 172 includes angled corners that connect substantially normal edges. The central surface 172 may be connected to a border surface 174 through multiple sloped surfaces 176. Only a subset of the sloped surfaces 176 are labelled in FIG. 1C. The border surface 174 may for part of the second leaf 134. Additionally, the border surface 174 may be connected via additional sloped surfaces 178 to corner surfaces 171. The corner surfaces 171 may connect to and/or make up one of the side portions 150A or 150B.

The central surface 172, the border surface 174, and the sloped surfaces 178 and 176 may provide or improve structural rigidity of the rear portion 170. Additionally, the central surface 172, the border surface 174, and the sloped surface 178 and 176 may at least partially define a volume that is immediately internal to the rear portion 170. The volume may be filled with an insulative material such as an insulative foam as described elsewhere in the present disclosure. The central surface 172, the border surface 174, and the sloped surface 178 and 176 may vary and define thicknesses of the insulative foam. For instance, the insulative foam may be thicker at a portion of the rear portion 170 near the lid 104. Accordingly, thermal transfer from an environment surrounding the cooler 100 to an internal volume defined by the cooler 100 through the rear portion 170 may be reduced around the lid 104. Such reduction may compensate or mitigate thermal transfer due to physical separation between the lid 104 and the tub portion 102.

In FIG. 1C, a subset of the foot assemblies 400 are visible. The foot assemblies 400 are positioned on the bottom portion 180, which is described below with reference to FIG. 1F. As shown in FIG. 1C, the foot assemblies 400 extend in a negative y direction from the bottom portion 180.

FIGS. 1D and 1E depict external views of the side portions 150A and 150B of the tub portion 102. The sides portions 150A and 150B may include one or more surfaces. For example, in the embodiment of FIGS. 1D and 1E, the sides portions 150A and 150B may each include a central surface 152A or 152B. The drain subassembly 140 may be positioned in the central surface 152A of the side portion 150A. The central surfaces 152A and 152B may be connected to a border surface 154A and 154B through multiple sloped surfaces 156A and 156B. Only a subset of the sloped surfaces 156A and 156B are labelled in FIGS. 1D and 1E. The border surfaces 154A and 154B may be connected via additional sloped surfaces 158A and 158B to corner surfaces 171 or 161. The corner surfaces 171 and 161 may connect to and/or make up the front portion 126 or the rear portion 170.

As described above, side portions 150A and 150B may be configured to retain the handles 106. The handles 106 may be retained relative to the side portions 150A and 150B. For instance, in the depicted embodiment, openings 153 may be defined in corners of the sloped surfaces 156A and 156B in which portions of the handles 106 are retained. In particular, the sloped surfaces 156A and 156B may include a portion that is substantially perpendicular to the central surfaces 152A and 152B which is connected to the border surfaces 154A and 154B via an angled surface. The openings 153 may be defined in the substantially perpendicular portions of the sloped surfaces 156A and 156B. The handles 106 may be configured to rotate relative to the side portions 150A and 150B. For instance, the handles 106 may be configured to rotate about axes 155A and 155B, which may be substantially parallel to the z-axis.

The central surfaces 152A or 152B, the border surfaces 154A and 154B, and the sloped surfaces 158A, 158B, 156A and 156B may provide or improve structural rigidity of the side portions 150A and 150B. Additionally, the central surfaces 152A or 152B, the border surfaces 154A and 154B, and the sloped surfaces 158A, 158B, 156A and 156B may at least partially define the volume that is immediately internal to the side portions 150A and 150B and may vary and define thicknesses of the insulative foam. For instance, the insulative foam may be thicker at a portion of the side portions 150A and 150B near the lid 104. Accordingly, thermal transfer from an environment surrounding the cooler 100 to an internal volume defined by the cooler 100 through the side portions 150A and 150B may be reduced around the lid 104. Such reduction may compensate or mitigate thermal transfer due to physical separation between the lid 104 and the tub portion 102.

In FIGS. 1D and 1E, a subset of the foot assemblies 400 are visible. The foot assemblies 400 are positioned on the bottom portion 180, which is described below with reference to FIG. 1F. As shown in FIGS. 1D and 1E, the foot assemblies 400 extend in a negative y direction from the bottom portion 180.

FIG. 1F depicts an external view of the bottom portion 180 of the tub portion 102. The bottom portion 180 may include a bottom surface 181 that may border each of the front portion 126, the rear portion 170, and the side portions 150A and 150B. The bottom surface 181 may define bottoms of the latch channels 160A and 160B that extend from the front portion 126. Aside from the latch channels 160A and 160B, the bottom surface 181 may be substantially flat (e.g., coplanar with a plane parallel to the XZ plane).

In the depicted embodiment, one of the foot assemblies 400 may be positioned at least proximate to each corner 182A-182D (generally, corner 182 or corners 182) of the bottom portion 180. For example, a first foot assembly 400A may be positioned at least proximate to a first corner 182A, a second foot assembly 400B may be positioned at least proximate to a second corner 182B, etc. The foot assemblies 400 may be oriented on the bottom surface 181 such that the angled portions 504 extend in an x-direction or negative x-direction off of the bottom surface 181 and extend in the y-direction up the side portions 150A and 150B. For example, the angled portions 504 of the first and second foot assemblies 400A and 400B may extend in the x direction from the bottom surface 181 and extend in the y-direction up the first side portion 150A. Similarly, the angled portions 504 of the third and fourth foot assemblies 400A and 400B may extend in the negative x direction from the bottom surface 181 and extend in the y-direction up the second side portion 150B.

Each of the foot assemblies 400 may be attached to the bottom portion 180 via one or more fasteners. For example, in FIG. 1F, each of the foot assemblies 400 are attached to the bottom portion 180 using four screws, which are positioned on a plane of the foot assemblies 400 substantially parallel to the bottom surface 181. In other embodiments, the foot assemblies 400 may be adhered to the bottom portion 180 and/or fasteners may be positioned at other locations on the foot assemblies 400.

In the embodiment of FIG. 1F, the cooler 100 includes four foot assemblies 400, one at each corner 182. In other embodiments, the cooler 100 may include one or more foot assemblies 400. For example, in some embodiments, the cooler 100 may include two foot assemblies 400. In these embodiments, the foot assemblies may extend a majority of the distance between two of the corners 182 and/or may be positioned centrally on the bottom surface 181. Additionally or alternatively, the cooler 100 may include more than four foot assemblies 400. For instance, the cooler 100 may include six foot assemblies 400. The six foot assemblies 400 may include one at each of the corners 182 along with one positioned between the corners 182.

Figure 1H:
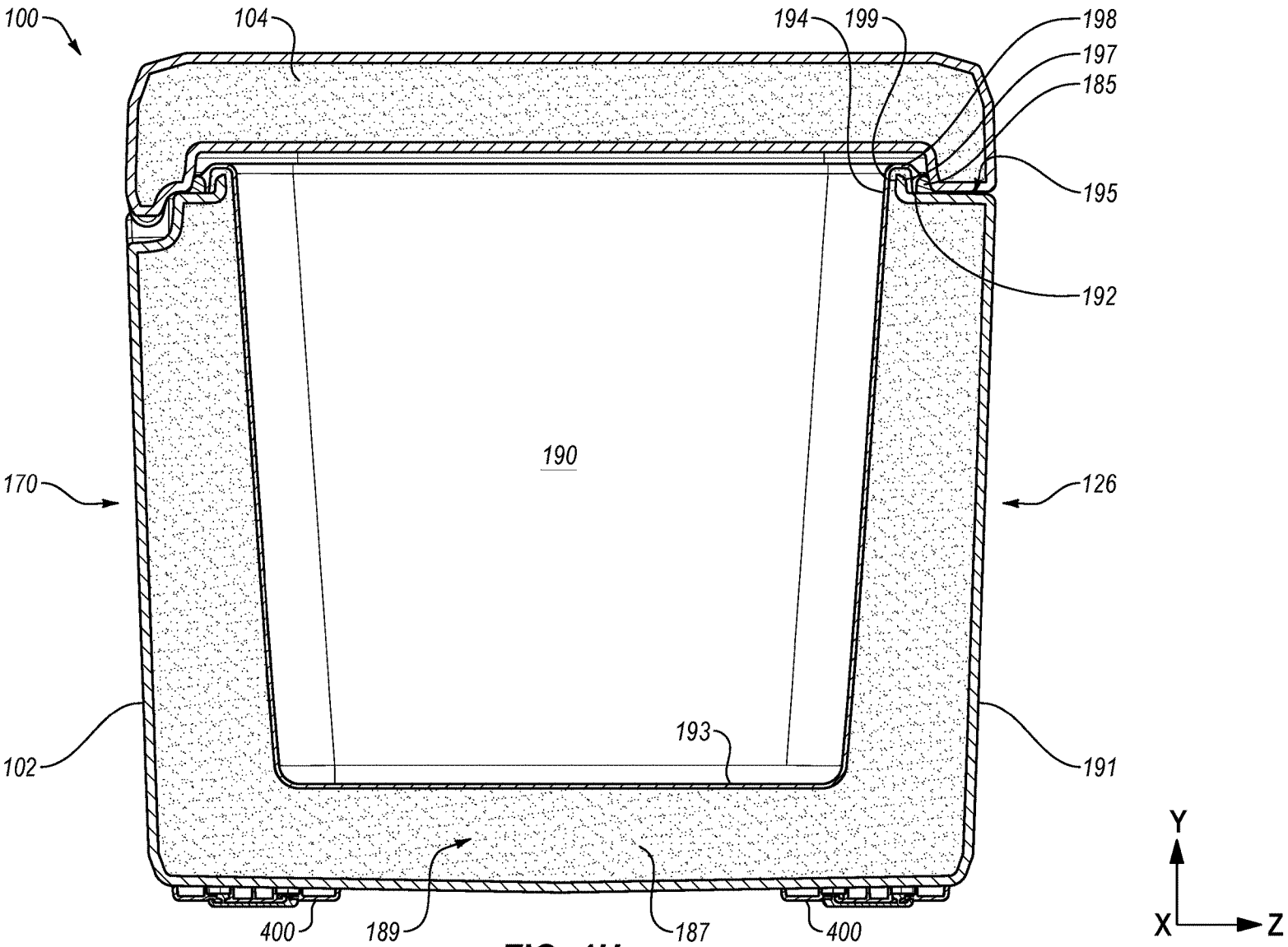
FIG. 1H illustrates a first sectional view of the cooler of FIG. 1A.
Figure 1I:
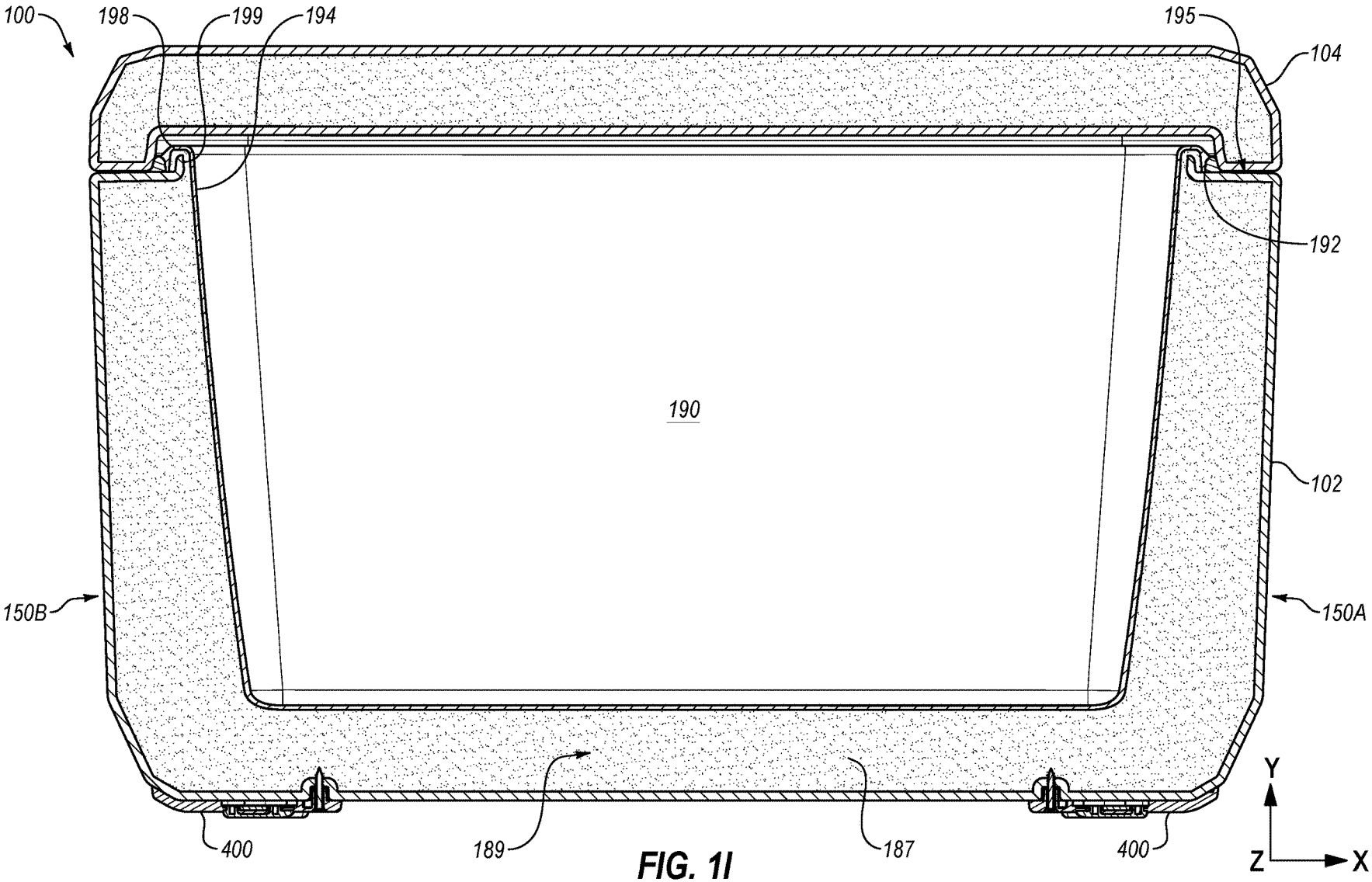
FIG. 1I illustrates a second sectional view of the cooler of FIG. 1A.

FIGS. 1H and 1I depict sectional views of the cooler 100. For instance, FIG. 1H depicts a first sectional view across a plane oriented in the yz plane. FIG. 1I depicts a second sectional view across a plane oriented in the yx plane. In the embodiment of FIGS. 1H and 1I, the tub portion 102 may be comprised of an exterior layer 191 and an interior layer 193. The exterior layer 191 may form the front portion 126, the rear portion 170, the side portions 150A and 150B, and the bottom portion 180 described with reference to FIGS. 1B-1F.

The exterior layer 191 may include a single integrated sheet of material that forms as a unitary, one-piece structure one or more or all of the exterior surfaces of the front portion 126, the rear portion 170, the side portions 150A and 150B, and the bottom portion 180. The exterior layer 191 may also include a top surface 195. The top surface 195 may be oriented in a plane that is substantially parallel to the xz plane and extend from the front portion 126, the rear portion 170, and the side portions 150A and 150B inward. For example, in FIG. 1H, the top surface 195 may extend from the front portion 126 in the negative z-direction and from the rear portion 170 in the positive z-direction. Similarly, in FIG. 1I, the top surface 195 may extend from the first side portion 150A towards the second side portion 150B and vice versa. The top surface 195 may be adjacent to a lower portion of the lid 104 when the lid 104 is in a closed position.

The top surface 195 may include a lip 197. The lip 197 may extend substantially normal to the top surface 195 at an interior perimeter 199 of the top surface 195. The top surface 195 may define a groove 192. The groove 192 may be defined in the top surface 195 and may extend in a negative y-direction.

The interior layer 193 may define an internal volume 190. During use of the cooler 100, materials and products may be placed in the internal volume 190. The materials and products placed in the internal volume 190 may in some embodiments have a volume of about 55 quarts. In other embodiments, the internal volume may have a volume that is greater than 55 quarts or less than 55 quarts.

The internal volume 190 may be generally rectangular. In some embodiments, the internal volume 190 may define a depression that may be connected to the drain subassembly 140. The depression may facilitate removal of liquids from the internal volume 190.

The interior layer 193 may include a generally ∩-shaped ("inverted-U"-shaped) channel 198 that extends around at least a portion of a perimeter 194. The ∩-shaped channel 198 of the internal volume 190 may extend over the lip 197 and into the groove 192. An outer edge of the ∩-shaped channel 198 may be sealed to the top surface 195.

An exterior cavity 189 may be defined between the interior layer 193 and the exterior layer 191. The exterior cavity 189 may be bordered by and surrounded by the exterior layer 191 and the interior layer 193. To generate the exterior cavity 189, the interior layer 193 may be positioned and/or secured relative to the exterior layer 191. With the exterior layer 191 positioned and/or secured relative to the interior layer 103, an insulative foam 187 may introduced into the exterior cavity 189. The insulative foam 187 may fill or substantially fill the exterior cavity 189. The insulative foam 187 may increase the r-value or the resistance to thermal transfer from an environment surrounding the cooler 100 to the internal volume 190.

In some embodiments, the exterior layer 191 may be formed using blow-molding process. For example, the contours and surfaces (e.g., 172, 152, 162, 166, 160, 174, 176, 171, 161, 152, etc.) may be defined in a rigid mold. A polymer or plastic such as polypropylene or another suitable plastic may be introduced into the mold in a molten or semi-molten state. A pressurized fluid may be introduced to the mold to force the polymer into the mold. The exterior layer 191 may be produced accordingly.

In these and other embodiments, the interior layer 193 may be injection molded. The interior layer 193 and the exterior layer 191 may be positioned in a press to hold the interior layer 193 relative to the exterior layer 191 and to prevent expansion or deformation of the exterior layer 191. In this arrangement, the exterior cavity 189 may be formed. The insulative foam may then be introduced into the exterior cavity 189. The insulative foam may be an expandable foam that after introduction into the exterior cavity 189 may expand to fill a majority or all of the exterior cavity 189.

In FIGS. 1H and 1I, the lid 104 is in a closed position relative to the tub portion 102. With the lid 104 in the closed position, the internal volume 190 is surrounded or enclosed by the tub portion 102 and the 104. The lid 104 may be formed using an injection molding process. The lid 104 may be filled with a foam or another insulative material.

FIGS. 2A-2C illustrate an exemplary embodiment of the cooler 100 with the lid 104 in an open position relative to the tub portion 102. FIG. 2A is a perspective view of the cooler 100. FIG. 2B is a side view of the cooler 100. FIG. 2C is another perspective view of the cooler 100.

In the open position, the lid 104 is rotated relative about the tub portion 102 about the pin(s) included in the hinges 110. For example, in FIGS. 2A-2C depicts the lid 104 rotated to an angle 183 relative to the tub portion 102. In the open position, the internal volume 190 is accessible. For instance, materials and/or products may be placed in the internal volume 190.

In FIGS. 2A-2C, a bottom portion 202 of the lid 104 is visible. The bottom portion 202 may define a recess 204. The recess 204 includes a boundary 206 that is disposed between a boundary surface 208 and an inner bottom surface 210. The boundary 206 may be configured to receive and interface with the ∩-shaped channel 198. When received in the boundary 206, the ∩-shaped channel 198 may thermally seal the internal volume 190. Additionally, when the ∩-shaped channel 198 is received in the boundary 206, the boundary surface 208 may contact or be immediately adjacent to the top surface 195 of the tub portion 102.

Additionally, in FIGS. 2A and 2C, recesses 212A and 212B may be defined in the lid 104. The recesses 212A and 212B may be configured to receive the hook portions 114 of the latches 108. For example, the recesses 212A and 212B may include a flat or substantially flat portion engaged by the hook portions 114 when the hook portions 114 are drawn in a negative y-direction.

Figure 3A:
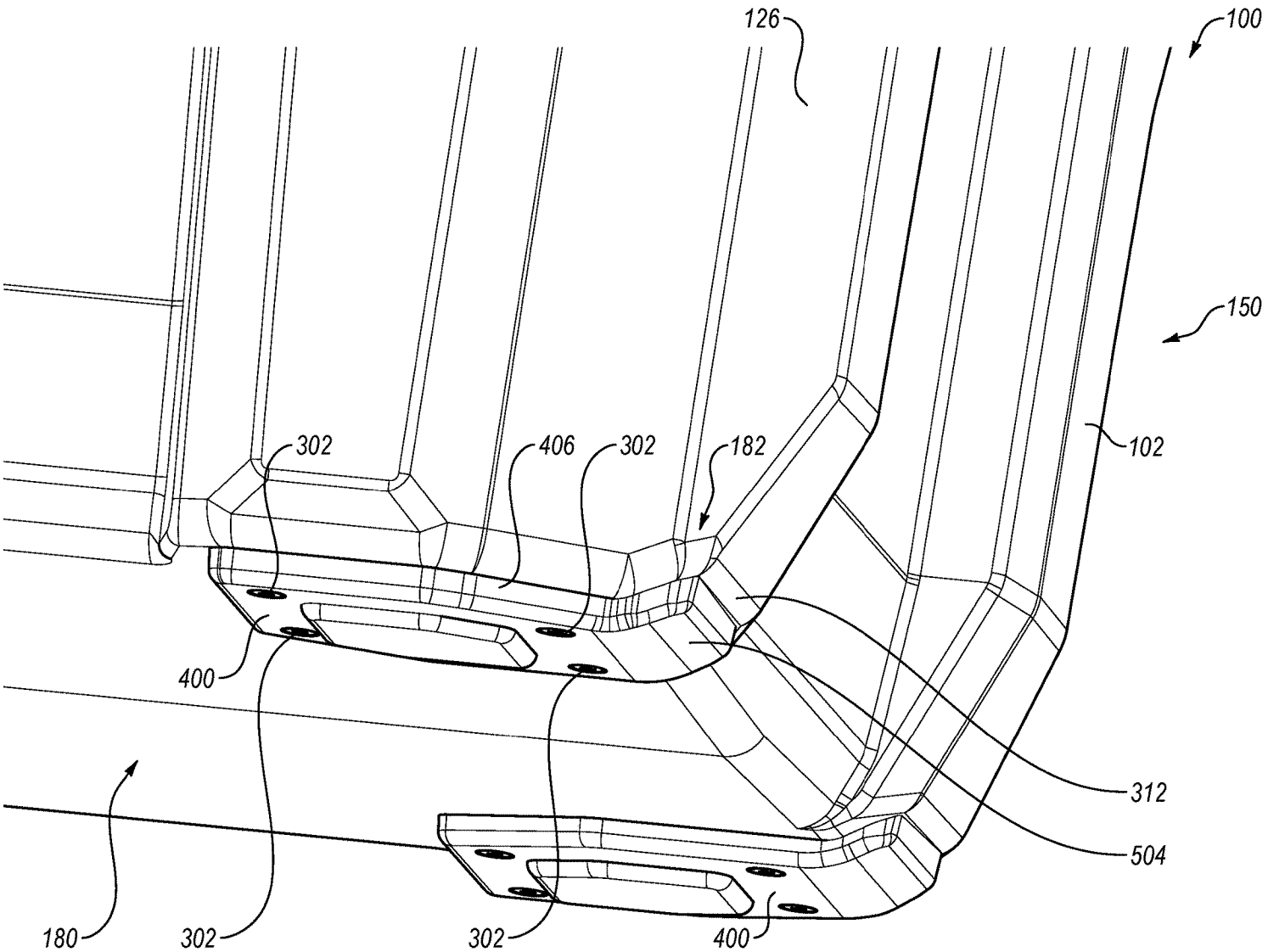
FIG. 3A illustrates an enlarged perspective view of exemplary foot assemblies attached to a portion of the cooler of FIG. 1A.
Figure 3B:
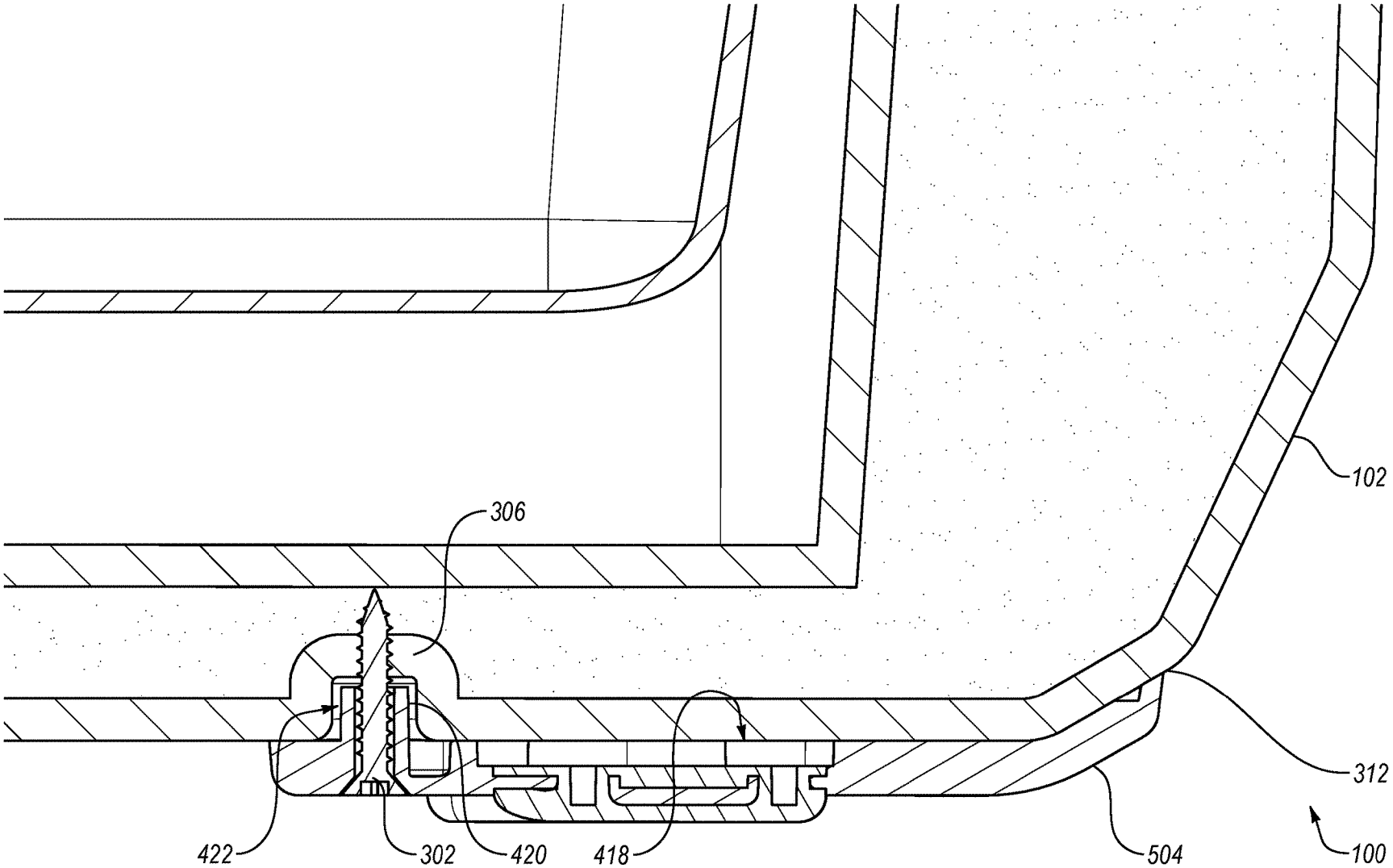
FIG. 3B illustrates a sectional view of one of the foot assemblies of FIG. 3A.
Figure 3C:
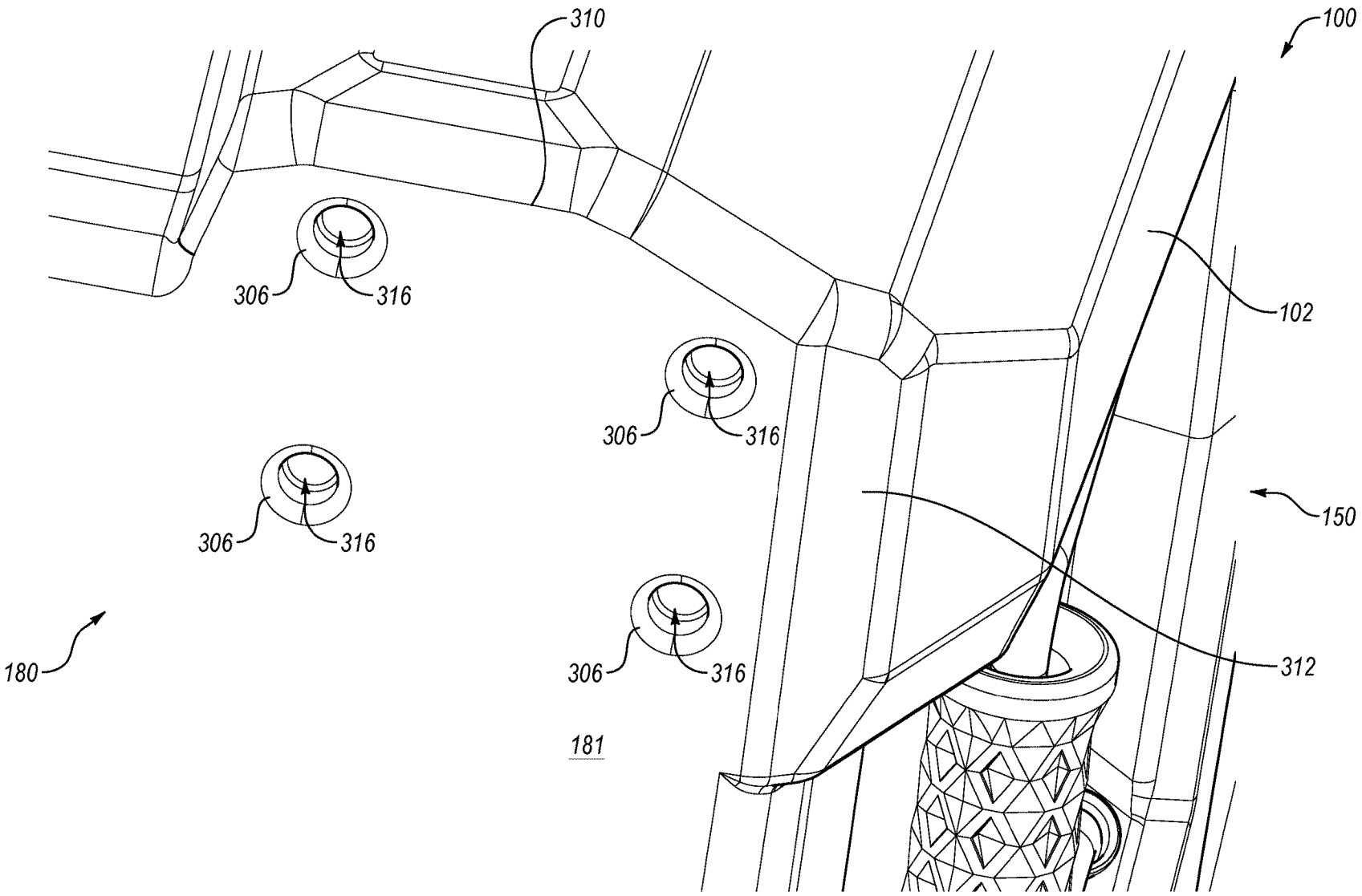
FIG. 3C illustrates an enlarged perspective view of portion of the cooler of FIG. 1A.
Figure 3D:
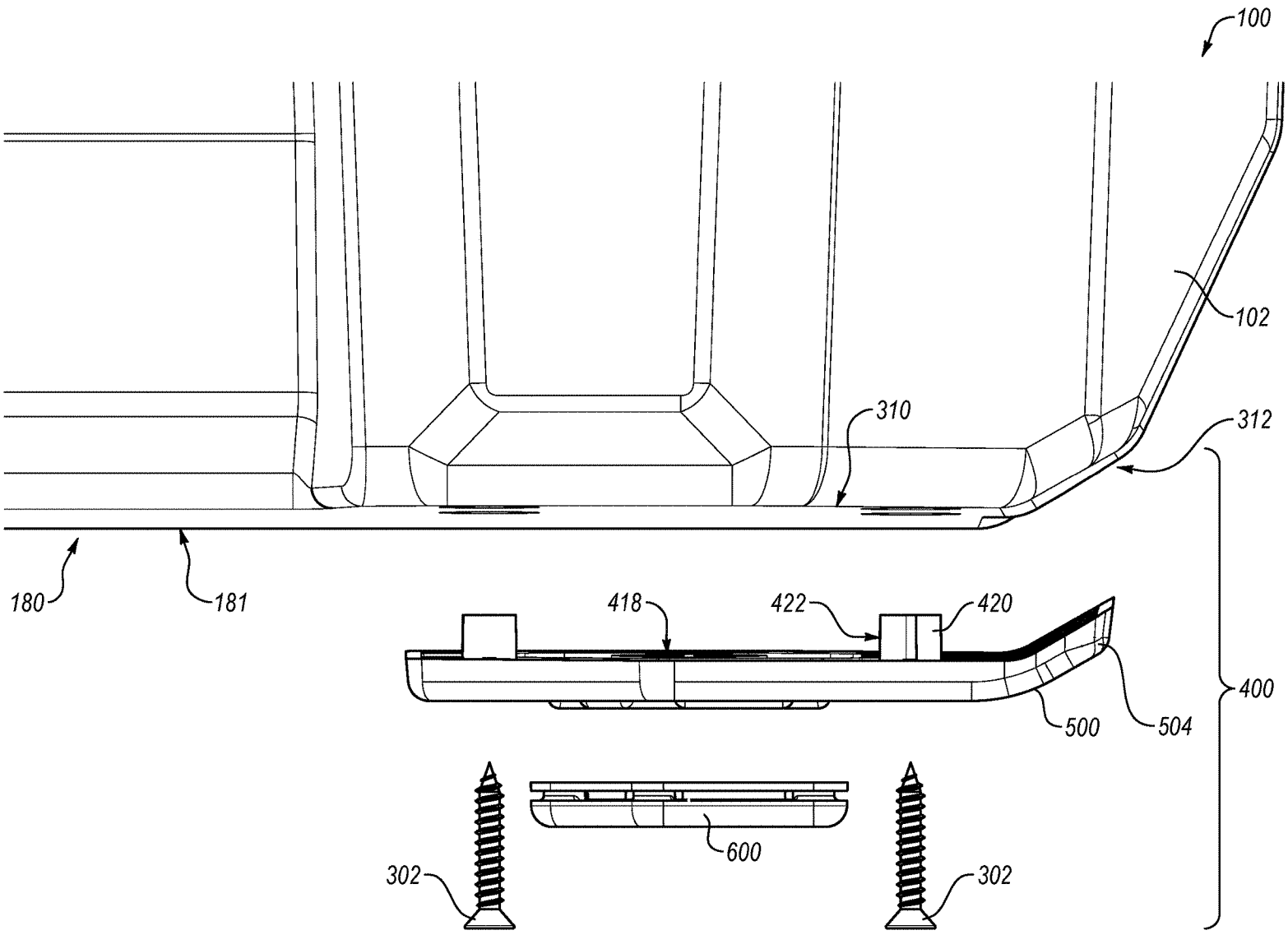
FIG. 3D illustrates of the foot assembly of FIG. 3B in an exploded configuration.

FIGS. 3A-3D illustrate detailed views of portions of the cooler 100. FIG. 3A depicts a detailed view of two of the foot assemblies 400 attached to portion of the tub portion 102. FIG. 3B depicts a sectional view of one of the foot assemblies 400 attached to a portion of the tub portion 102. FIG. 3C depicts a detailed view of the bottom portion 180 without a foot assembly. FIG. 3D depicts one of the foot assemblies 400 exploded from a portion of the tub portion 102.

Assembly of the foot assemblies 400 onto the tub portion 102 may include positioning the foot assemblies on the corner 182 of the bottom portion 180. In particular, with reference to FIGS. 3A, 3B, and 3C, the foot assemblies 400 may be positioned such that an outer edge 406 of the foot assemblies 400 substantially meet an outer edge 310 of the bottom surface 181. The outer edge 310 of the bottom surface 181 may include a shape that is substantially similar to the outer edge 406 of the foot assembly 400. In addition, the angled portion 504 may contact an angled contact surface 312 of the tub portion 102. The angled contact surface 312 may extend between the bottom surface 181 and the side portion 150A. Contact between the angled contact surface 312 and the angled portion 504 of the foot assembly 400 may enable support of the tub portion 102 when the cooler 100 is oriented at an angle such that the weight of the cooler 100 rests on the angled portion 504.

With reference to FIGS. 3A, 3B, and 3C, the foot assemblies 400 may be attached to the corner 182 of the bottom portion 180 using fasteners 302. To enable the attachment of the foot assemblies 400, the bottom portion 180 may define fastener housing receivers 306. The fastener housing receiver 306 may extend into the bottom portion 180 and define a volume into which fastener housings 420 may be positioned. The fasteners 302 may be received in the fastener housings 402 and threaded or otherwise attached directly to a portion of the exterior layer 191 that makes up the fastener housing receivers 306.

In some embodiments, the fastener housing receiver 306 may be sized such that an outer surface 422 of the fastener housings 402 contacts at least a portion of the inner surface 316 of the fastener housing receiver 306. Contact between the fastener housings 402 and the fastener housing receiver 306 may provide or improve rigidity between the bottom portion 180 and the foot assemblies 400.

With the fastener housings 402 positioned in the fastener housing receivers 306, an interior surface 418 of the foot assemblies 400 may contact or be immediately adjacent to the bottom surface 181 of the bottom portion 180.

Figure 4A:
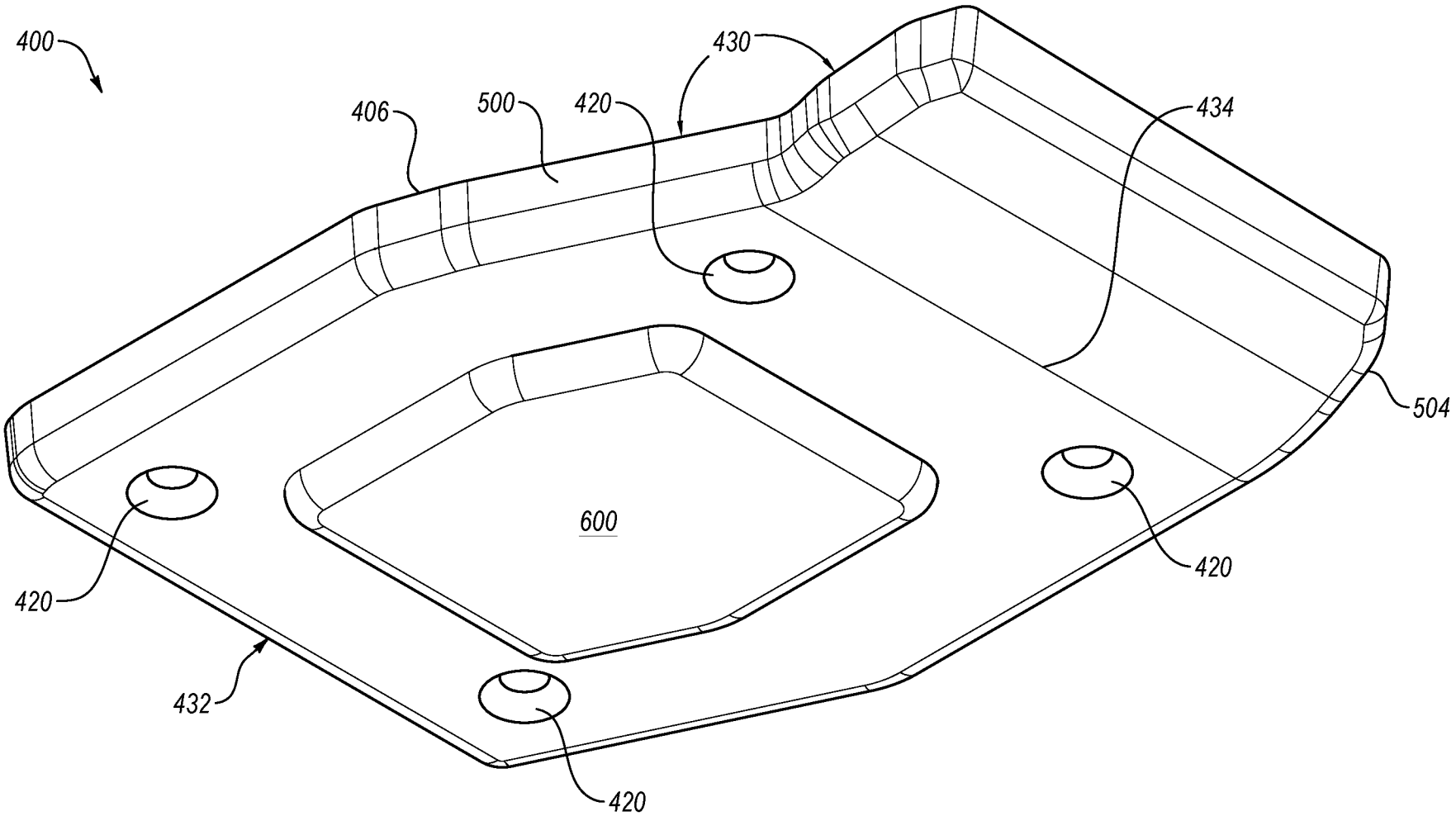
FIG. 4A illustrates an enlarged perspective view of the foot assembly of FIG. 3A.
Figure 4B:
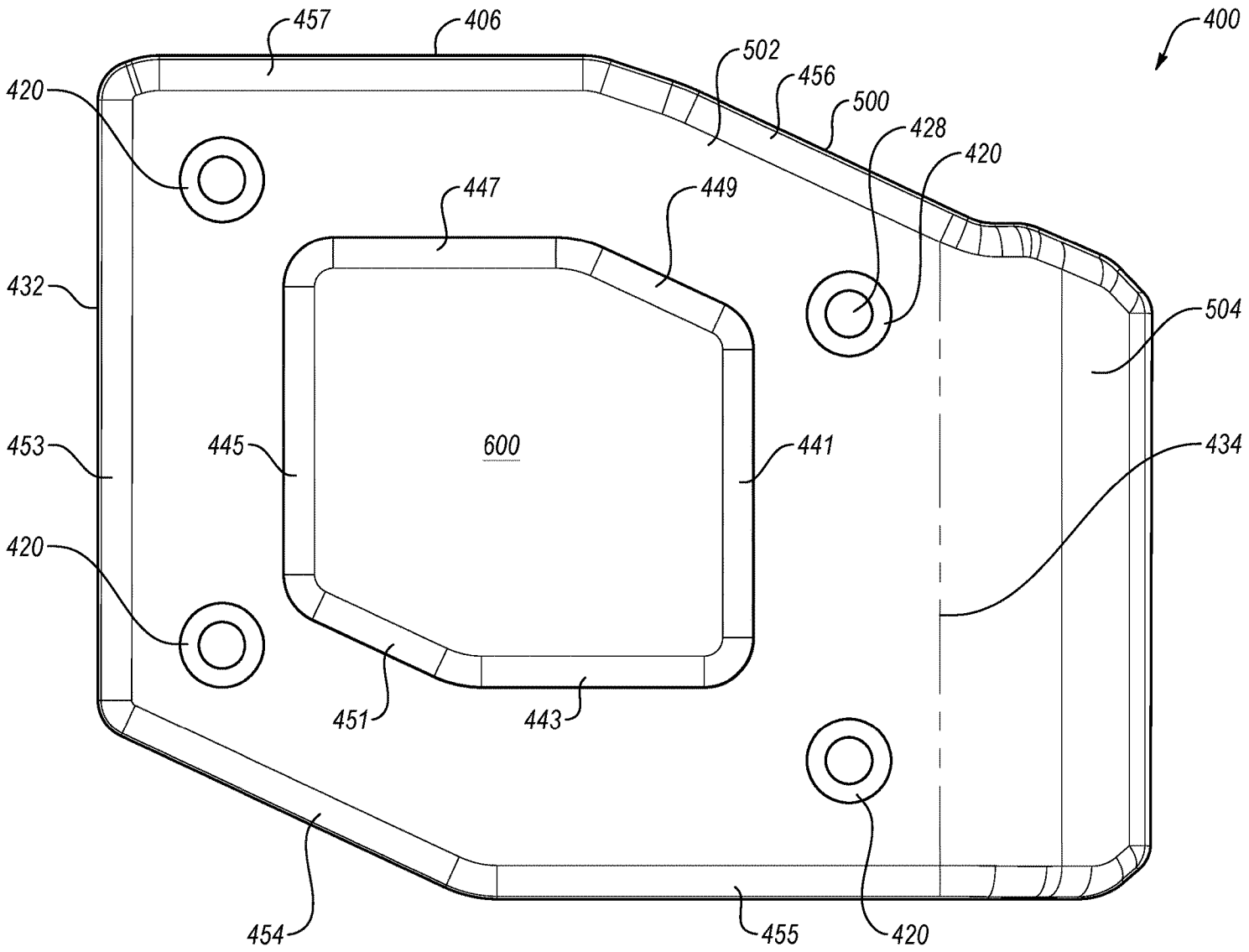
FIG. 4B illustrates a bottom view of the foot assembly of FIG. 4A.
Figure 4C:
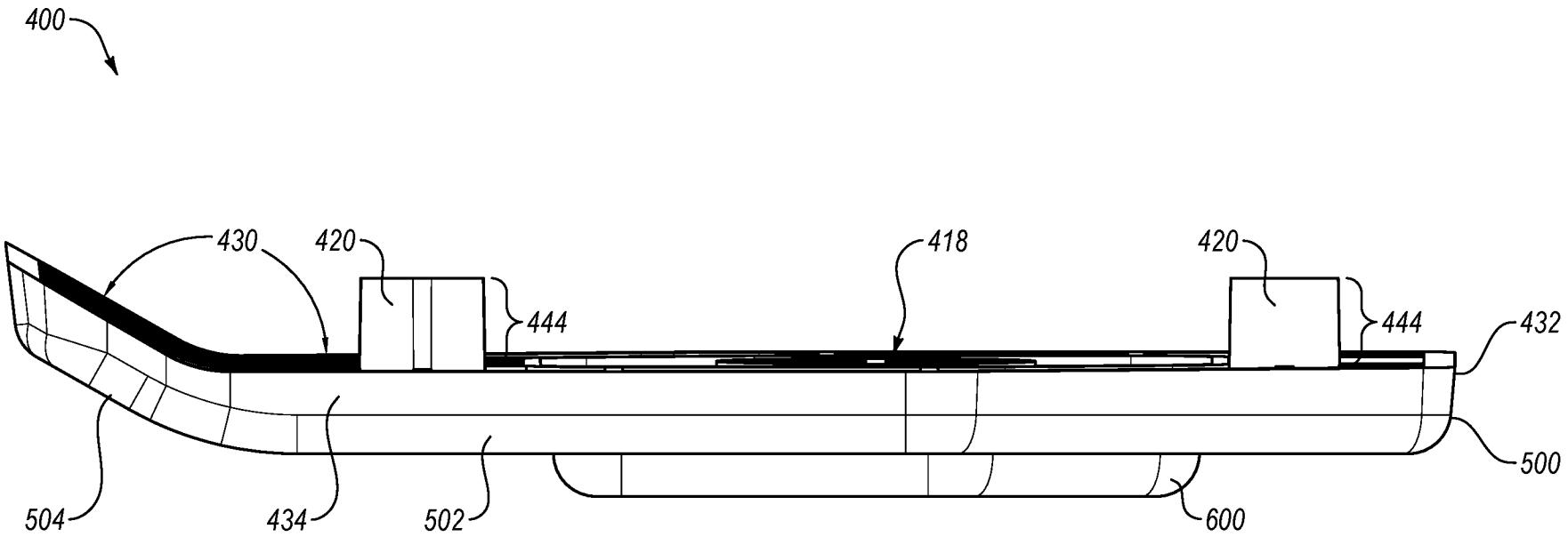
FIG. 4C illustrates a side view of the foot assembly of FIG. 4A.

FIGS. 4A-4C illustrate an exemplary embodiment of the foot assembly 400. FIG. 4A depicts a perspective view of the foot assembly 400. FIG. 4B depicts a side view of the foot assembly 400. FIG. 4C depicts a bottom view of the foot assembly 400. The foot assembly 400 in FIGS. 4A-4C is depicted without the tub portion 102 described elsewhere in the present disclosure. The foot assembly 400 of FIGS. 4A-4C may be implemented with the tub portion 102 or may be implemented with another suitable structure. For instance, the foot assembly 400 may be implemented with a storage box, a piece of luggage, an appliance, or another structure that may be selectively movable. The foot assembly 400 may be configured to support the structure relative to a surface and to enable translation of the structure when the oriented such that the angled portion 504 contacts the surface.

The foot assembly 400 may include a block retainer 500 and a non-skid block 600. The block retainer 500 may include a planar portion 502 and the angled portion 504. The planar portion 502 may extend from a first end 432 to a second end 434 at which the angled portion 504 is attached or integrally formed with the planar portion 502.

The angled portion 504 may extend at an angle 430 from the planar portion 502. The angle 430 may be selected to coincide with the structure on which the foot assembly 400 is implemented. For example, with combined reference to FIGS. 4C and 3C, the angle 430 may be selected to coincide with an angle between the bottom surface 181 and the angled contact surface 312. For instance, the angle 430 may between 90 degrees and 180 degrees, between 120 degrees to 160 degrees, or between 135 degrees and 145 degrees.

The block retainer 500 includes the interior surface 418. As discussed above, the interior surface 418 may be configured to be positioned adjacent to or in contact with a bottom surface of a structure on which the foot assembly 400 is implemented. The second end 434 may be positioned on an edge of the bottom surface such that the block retainer 500 extends along the bottom surface and directly contacts the bottom surface. For example, with reference to FIGS. 4C and 3C, the second end 434 may be placed at a transition between the bottom surface 181 and the angled contact surface 312. The planar portion 502 may accordingly be immediately adjacent to or in contact with the bottom surface 181. Also, the angled portion 504 may be immediately adjacent to or in contact with the angled contact surface 312. Such placement enables the foot assembly 400 to support in a stacked arrangement the cooler 100.

The planar portion 502 may define the fastener housings 420. The fastener housings 420 may be positioned between the non-skid block 600 and the outer edge 406. The fastener housings 420 may each define a fastener opening 428. The fastener openings 428 may be configured to receive a fastener (e.g., fastener 302) that attaches the planar portion 502 to the structure. With reference to FIG. 4C, the fastener housings 420 may include an elongated portion 444. The elongated portion 444 may protrude substantially normal to the interior surface 418. The elongated portion 444 may be configured to extend into a fastener housing receiver such as the fastener housing receiver 306 of FIG. 3C.

With reference to FIGS. 4A and 4C, the non-skid block 600 may take up a particular portion of a front surface 452 of the planar portion 502. For instance, the non-skid block 600 may include about 25% of an area of the front surface 452 of the planar portion 502. In other embodiments, the non-skid block 600 may include about 20%, 35%, 40%, 50%, or another suitable percentage of the area of the front surface 452 of the planar portion 502. Additionally, in some embodiments, a shape of the non-skid block 600 may be similar to and/or may correspond to an outer edge 406 of the block retainer 500. For example, with reference to FIG. 4B, the non-skid block 600 may include a first block edge 447 that may be substantially perpendicular to a second block edge 445. The first block edge 447 may be connected to a third block edge 441 via a first angled edge 449. The third block edge 441 may be substantially normal to a fourth block edge 443. The fourth block edge 443 may be connected to the second block edge 445 via a second angled edge 451. The fourth block edge 443 may be substantially parallel to the first block edge 447. The second block edge 445 may be substantially parallel to the third block edge 441. The first angled edge 449 may be substantially parallel to the second angled edge 451.

The outer edge 406 of the planar portion 502 may be configured similarly to the non-skid block 600. For instance, the block retainer 500 may include a first retainer edge 453 that is substantially normal to a third retainer edge 455 and a fifth retainer edge 457. The first retainer edge 453 may be connected to the third retainer edge 455 via a first angled retainer edge 453. The fifth retainer edge 457 may be connected to a second angled retainer edge 456. The second angled retainer edge 456 may end at the second end 434 of the planar portion 502. Similarly the third retainer edge 455 may end at the second end 434. The first retainer edge 453 may be substantially parallel to the second end 434. The outer edge 406 may be defined such that there is a substantially equal distance between the edges (e.g., 447, 449, 441, 443, 451, and 445) of the non-skid block 600 and the outer edge 406. The fastener housings 420 may be defined in the portions of the planar portion 502 between the edges of the non-skid block 600 and the outer edge 406.

Figure 5A:
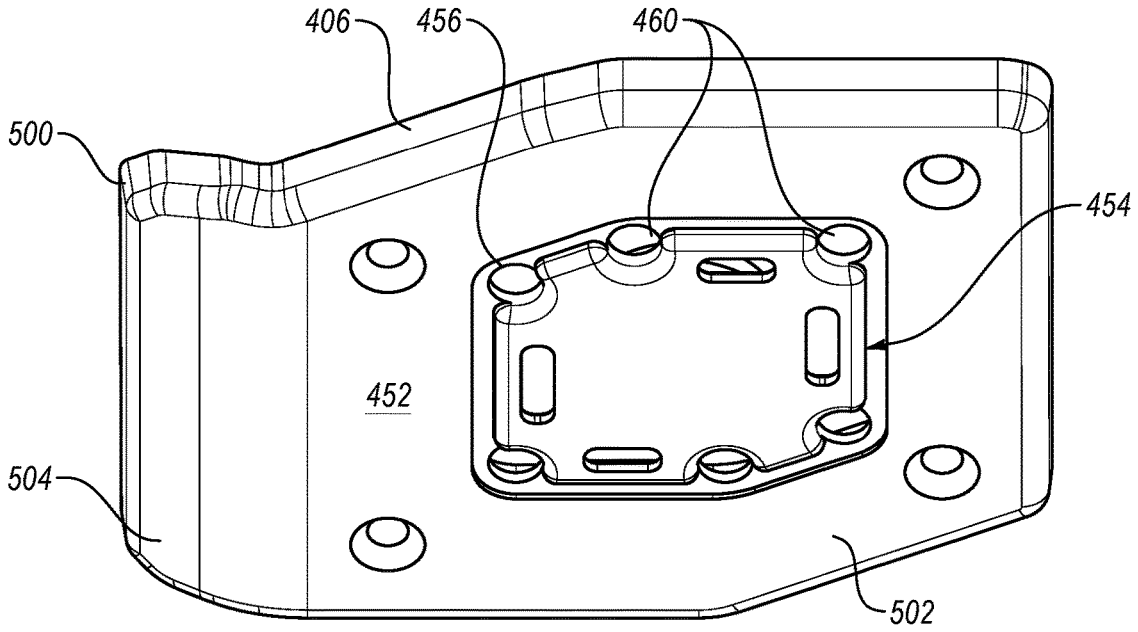
FIG. 5A illustrates a perspective view of an exemplary block retainer that may be implemented in the foot assembly of FIG. 4A.
Figure 5B:
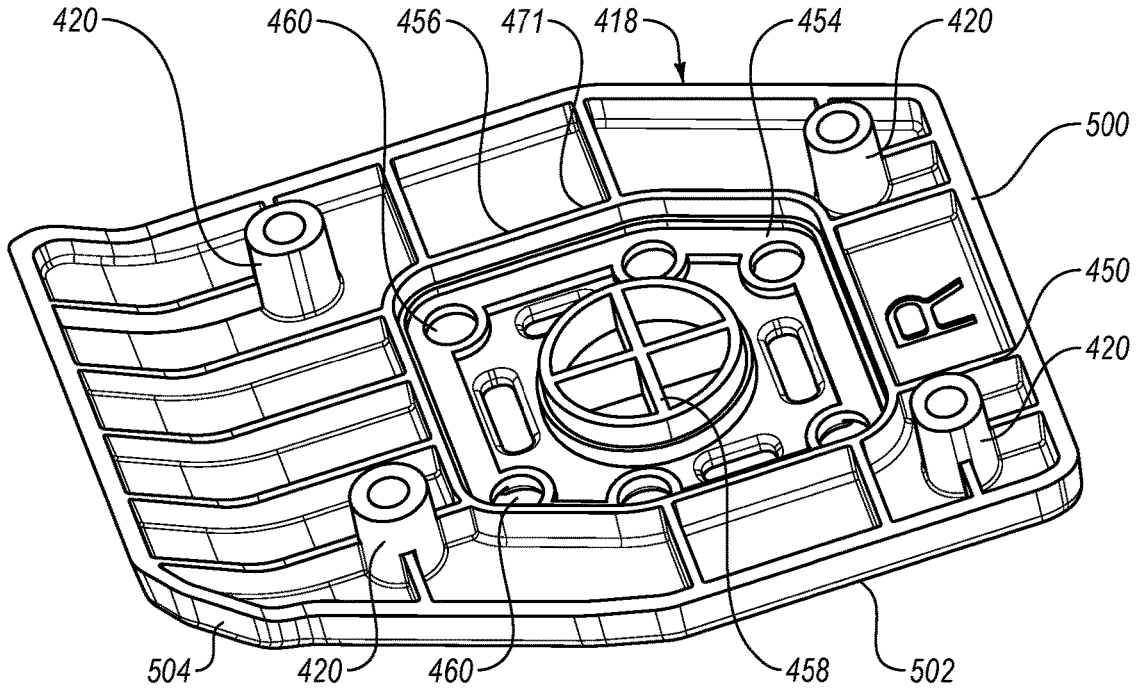
FIG. 5B illustrates another perspective view of the block retainer of FIG. 5A.

FIGS. 5A and 5B illustrate an exemplary embodiment of the block retainer 500 that may be implemented in one or more of the foot assemblies 400 described elsewhere in the present disclosure. In FIGS. 5A and 5B, the block retainer 500 is depicted as a separate component from the non-skid block 600 and the tub portion 102 of the cooler 100. It may be understood with the benefit of the present disclosure that the block retainer 500 or one or more components and features thereof may be integrally formed with the non-skid block 600. Additionally, the block retainer 500 may be separated into multiple components.

The block retainer 500 may include the planar portion 502 and the angled portion 504. The planar portion 502 may include the interior surface 418. The interior surface 418 may be configured to be positioned immediately adjacent to or in contact with a bottom surface of a structure such as the bottom surface 181 of the tub portion 102 described elsewhere in the present disclosure.

In the embodiment of FIG. 5B, the block retainer 500 may include the front surface 452, which may be opposite the interior surface 418. The front surface 452 may include a DCOF that is different from a coefficient of friction of the non-skid block. When the block retainer 500 is positioned on the structure, the solid front surface 452 may be an external surface. The outer edge 406 may extend from the front surface 452. For example, in FIG. 5A, the outer edge 406 may be substantially normal to the front surface 452.

A block opening 454 may be defined in a central region of the planar portion 502. The block opening 454 may include a perimeter 471 that substantially corresponds to an outer perimeter of a non-skid block such as the non-skid block 600. The block opening 454 may include one or more protrusions that may be received in a recess of the non-skid block. Additionally, the block retainer 500 may include one or more ribs 450. The ribs 450 may extend from the outer edge 406 to the fastener housings 420 and between the outer edge 406 and the perimeter 471 that extends around at least a portion of the block opening 454. The ribs 450 may provide rigidity to the block retainer 500. In embodiments including the ribs 450, the interior surface 418 may be an outer surface of the ribs 450.

A cylindrical structure 458 may be included in a central portion of the block opening 454. The cylindrical structure 458 may be disposed between the non-skid block and the bottom surface of the structure. The cylindrical structure 458 may support the non-skid block. Multiple openings 460 may be defined in the block opening 454. The openings 460 may be configured to receive features of the non-skid block.

Figure 6A:
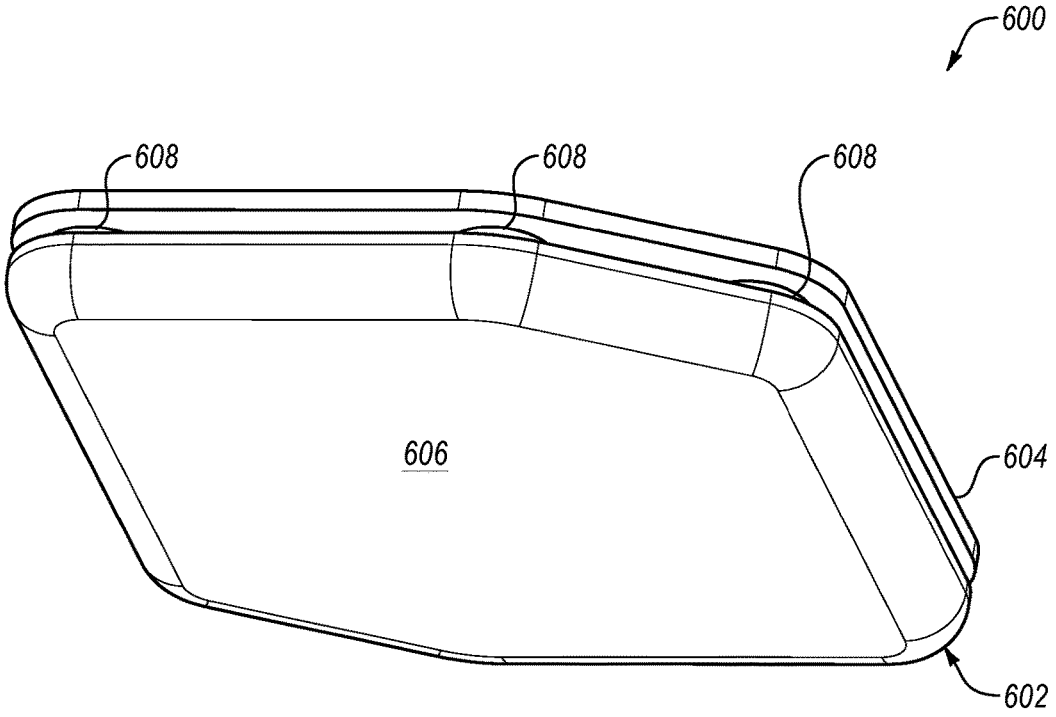
FIG. 6A illustrates an enlarged lower perspective view of an exemplary non-skid block that may be implemented in the foot assembly of FIG. 4A.
Figure 6B:
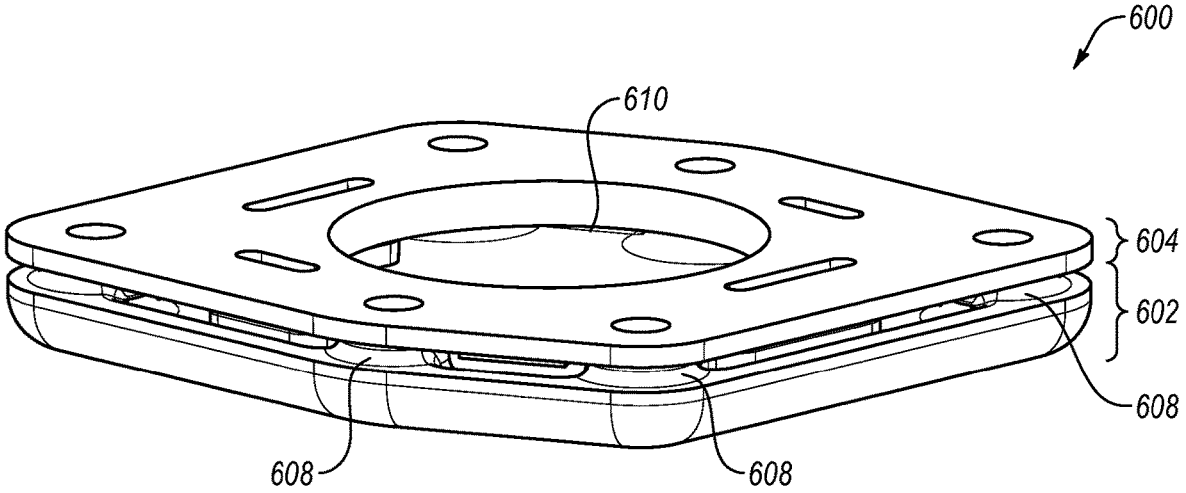
FIG. 6B illustrates another perspective view of the non-skid block of FIG. 6A.

FIGS. 6A and 6B illustrate an exemplary embodiment of the non-skid block 600 that may be implemented in one or more foot assemblies 400 described elsewhere in the present disclosure. FIG. 6A depicts a lower perspective view of the non-skid block 600. FIG. 6B depicts an upper perspective view of the non-skid block 600. The non-skid block 600 may include an external portion 602. The external portion 602 may extend above the front surface 452 of the planar portion 502 when the non-skid block 600 is positioned in the block opening 454. The external portion 602 of the non-skid block 600 may include an contact surface 606. The contact surface 606 may include a DCOF that is different from a DCOF of the angled portion 504 of the block retainer 500.

The non-skid block 600 may include an inner block structure 604. The inner block structure 604 may be configured to be received in the block opening 454. In particular, the inner block structure 604 may be attached to the external portion 602 via one or more connectors 608. The connectors 608 may extend through the openings 460 defined in the block opening 454.

The non-skid block may also define a cylindrical opening 610. The cylindrical opening 610 may be configured to receive the cylindrical structure 458. When the cylindrical structure 458 is received in the cylindrical opening 610, an end of the cylindrical structure 458 may contact an inner surface of the external portion 602 of the non-skid block 600. Contact between the cylindrical structure 458 may transfer weight of the structure (e.g., the tub portion 102) to the external portion of the non-skid block 600.

Figure 7A:
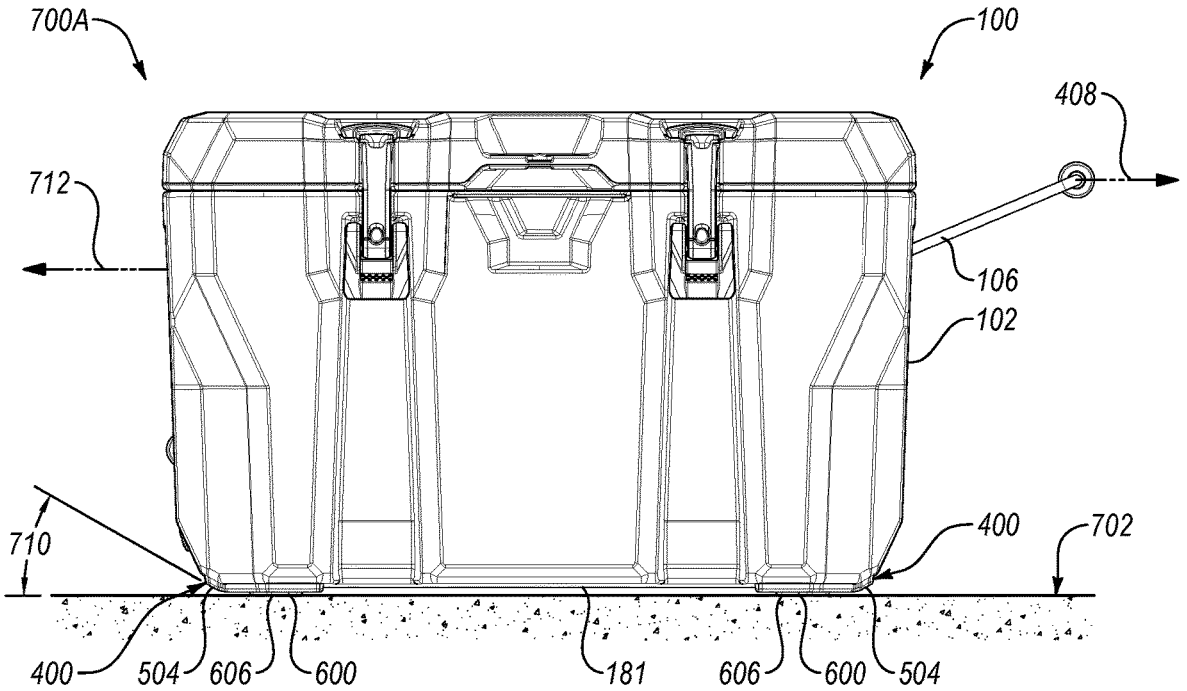
FIG. 7A illustrates a front view of a first exemplary orientation of the cooler of FIG. 1A.
Figure 7B:
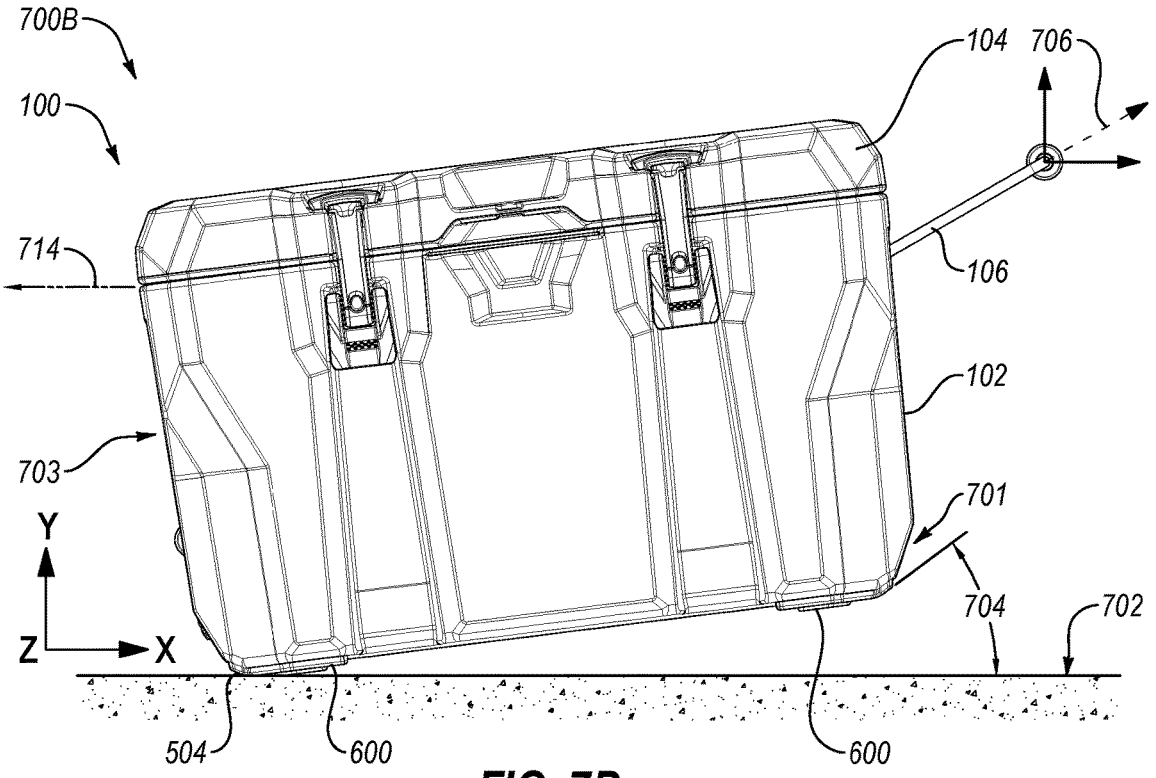
FIG. 7B illustrates a front view of a second exemplary orientation of the cooler of FIG. 1A, all in accordance with at least one embodiment described in the present disclosure.

FIGS. 7A and 7B illustrate example orientations 700A and 700B of an exemplary embodiment of the cooler 100 relative to a surface 702. The orientations 700A and 700B depict orientations of the cooler 100 that may change a magnitude and/or a direction of forces 706 and 708 involved in translation of the cooler 100 relative to the surface 702.

In FIG. 7A, a first orientation 700A is depicted. In the first orientation 700A, the bottom surface 181 is substantially parallel to the surface 702. Accordingly, the non-skid blocks 600 of the foot assemblies 400 may be in contact with the surface 702. In addition, the angled portion 504 of the foot assembly 400 may be separated from the surface 702. In particular, the angled portion 504 may be separated from the surface by a separation angle 710.

In the first orientation 700A, a first orientation force 708 may be applied to the handle 106. To translate the cooler 100 relative to the surface 702, the first orientation force 708 may be greater than a first frictional resistance 712 that is acting against the first orientation force 708. The first frictional resistance 712 is based on the DCOF of the contact surfaces 606 of the non-skid blocks 600 and a weight of the cooler 100 and any materials and products placed in the internal volume defined by the cooler 100.

FIG. 7B depicts a second orientation 700B. In the second orientation 700B, a first portion 701 of the cooler 100 may be lifted (displaced in the y-direction) from the surface 702. A second portion 703 of the cooler 100 may remain on the surface 702. Accordingly, the cooler 100 may be rotated in a plane substantially parallel to the yx-plane of FIG. 7B. The cooler 100 may be rotated by a displacement angle 704, which may tip the cooler 100 such that the angled portion 504 of the foot assembly 400 may be in contact with the surface 702. The displacement angle 704 may be sufficient to overcome the separation between the angled portion 504 from the surface 702. For example, the displacement angle 704 may be greater than the separation angle 710 of FIG. 7A. In addition, with the first portion 701 of the cooler 100 lifted from the surface 702, the contact surfaces 606 of the non-skid blocks 600 may be separated from the surface 702.

In the second orientation 700B, a second orientation force 706 may be applied to the handle 106. To translate the cooler 100 relative to the surface 702, the second orientation force 706 may be greater than a second frictional resistance 714 that is acting against the second orientation force 706. Because the angled portion 504 is in contact with the surface 702 and the non-skid blocks 600 are separated from the surface 702, the second frictional resistance 714 is based on the DCOF of the angled portion 504 and not the DCOF of the non-skid blocks 600. The weight of the cooler 100 and any materials and products placed in the internal volume defined by the cooler 100 are still a factor in the second frictional resistance 714.

In some embodiments, the DCOF of the angled portion 504 may be less than the DCOF of the non-skid blocks 600. In these and other embodiments, the first orientation force 708 may be greater than the second orientation force 706. Accordingly, orientation of the cooler 100 in the second orientation 700B, may reduce a force involved in translation of the cooler 100 relative to the surface 702.

One of ordinary skill in the art will appreciate after reviewing this disclosure that the foot assemblies and the coolers may have other suitable shapes, sizes, configurations, and arrangements depending, for example, upon the intended use of the cooler or the foot assembly. One of ordinary skill in the art will also appreciate that different components of the foot assemblies and the coolers may have various shapes, sizes, configurations, and arrangements depending, for example, upon the intended use thereof. Further, one of ordinary skill in the art will appreciate the cooler or the foot assemblies may include any suitable number or combination of features or aspects.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A foot assembly configured to support a structure relative to a surface, the foot assembly comprising:

a block retainer configured to be positioned at least proximate a bottom surface of a structure and a side surface of the structure, the block retainer comprising:

a planar portion having an interior surface that is configured to contact the bottom surface;

an angled portion disposed at an angle from the planar portion, the angled portion including an interior surface that is configured to contact an angled contact surface of the structure; and a front surface including a first dynamic coefficient of friction; and a non-skid block connected to the planar portion, the non-skid block including an exterior portion that extends from the front surface in a direction away from the structure, the exterior portion of the non-skid block including a second dynamic coefficient of friction that is greater than the first dynamic coefficient of friction.

2. The foot assembly of claim 1, wherein:

the foot assembly enables the structure to be configured in a first orientation and in a second orientation relative to the surface;

in the first orientation the planar portion is positioned substantially parallel to the surface and the non-skid block contacts the surface such that a frictional resistance to translation relative to the surface is based on the second dynamic coefficient of friction; and in the second orientation the front surface of the angled portion contacts the surface such that the frictional resistance to the translation relative to the surface is based on the first dynamic coefficient of friction.

3. The foot assembly of claim 1, further comprising a fastener housing, wherein:

the fastener housing including a fastener opening that is configured to receive a fastener that attaches the block retainer to the structure;

the fastener housing including an elongated portion that protrudes substantially normal to the planar portion; and the elongated portion is configured to be received into a fastener housing receiver at least partially defined in the bottom surface of the structure.

4. The foot assembly of claim 3, wherein the block retainer includes an outer edge at least a portion of which is configured to be aligned with an outer edge of the bottom surface of the structure.

5. The foot assembly of claim 4, wherein the block retainer includes a block opening in which the non-skid block is retained relative to the block retainer.

6. The foot assembly of claim 5, wherein:

the block retainer includes one or more ribs that extend from the outer edge to the fastener housing and between the outer edge to an inner perimeter that extends around at least a portion of the block opening; and the interior surface of the planar portion is defined on a surface of at least one of the ribs.

7. The foot assembly of claim 5, wherein the non-skid block includes an external portion that extends above the front surface of the planar portion when positioned in the block opening and an inner block structure that is configured to be received in the block opening.

8. The foot assembly of claim 1, wherein the angle at which the angled portion is disposed from the planar portion is:

between 90 degrees and 180 degrees;

between 120 degrees to 160 degrees; or between 135 degrees and 145 degrees.

9. A cooler comprising:

the structure; and the foot assembly of claim 1, wherein the structure includes a tub portion; and the tub portion includes an exterior layer that is a unitary one-piece blow-molded structure.

10. A cooler comprising:

a tub portion that includes a bottom portion that is connected to a side portion via an angled contact surface; and a foot assembly that is positioned partially on the bottom portion and partially on the angled contact surface, wherein the foot assembly includes a planar portion that is positioned on the bottom portion that includes a non-skid block having a first dynamic coefficient of friction, and an angled portion that is positioned on the angled contact surface, the angled portion having a second dynamic coefficient of friction that is greater than the first dynamic coefficient of friction.

11. The cooler of claim 10, wherein:

the cooler is configurable in a first orientation in which the planar portion is positioned substantially parallel to a surface such that the non-skid block contacts the surface to increase frictional resistance to translation of the cooler relative to the surface, and the cooler is configurable in a second orientation in which the angled portion is in contact with the surface to reduce frictional resistance to the translation of the cooler relative to the surface.

12. The cooler of claim 10, wherein:

the tub portion includes an exterior layer and an interior layer that that is positioned within the exterior layer;

an exterior cavity is included between the exterior layer and the interior layer; and an insulative material disposed in the exterior cavity.

13. The cooler of claim 12, wherein the exterior layer is a unitary one-piece blow-molded structure that includes the bottom portion, the side portion, a top surface, a front portion, a rear portion, and another side portion.

14. The cooler of claim 13, wherein:

the top surface includes a lip that extends substantially normal to an interior perimeter of the top surface;

the top surface includes a groove; and the interior layer includes a n-shaped channel that extends around at least a portion of a perimeter of the interior layer that extends over the lip and into the groove.

15. The cooler of claim 12, further comprising a fastener housing receiver that is at least partially defined in a bottom surface of the bottom portion, wherein:

the foot assembly includes a fastener housing that includes an elongated portion that protrudes substantially normal to the planar portion and that includes a fastener opening that is configured to receive a fastener; and the fastener housing receiver is sized such that an outer surface of the fastener housing contacts at least a portion of an inner surface of the fastener housing receiver when the fastener housing is received in the fastener housing receiver.

16. The cooler of claim 15, wherein the planar portion and the angled portion are integrated into a block retainer that includes a block opening in which the non-skid block is retained.

17. A cooler comprising:

a lid;

a tub portion that includes a bottom portion that is connected to side portions via angled contact surfaces, wherein the tub portion is comprised of an exterior layer, an interior layer positioned in the exterior layer that defines an internal volume, and an insulative foam introduced in an external cavity defined between the interior layer and the exterior layer;

a hinge that rotatably couples the lid to the tub portion such that the lid is positionable in an open position relative to the tub portion in which the internal volume is open to a surrounding environment and a closed position relative to the tub portion in which the internal volume is substantially enclosed; and four foot assemblies positioned at least proximate to corners of the bottom portion and aligned with an outer edge of a bottom surface of the bottom portion, wherein:

each foot assembly of the four foot assemblies includes a planar portion having an interior surface that contacts the bottom surface, an angled portion that extends at an angle from the planar portion and contacts the angled contact surface, and a front surface that is opposite the interior surfaces that includes a first dynamic coefficient of friction; and a non-skid block that is retained in the planar portion, the non-skid block including an exterior portion that extends from the front surface in a direction away from the bottom portion that includes a second dynamic coefficient of friction that is greater than the first dynamic coefficient of friction;

the cooler is configurable in a first orientation in which the planar portion is positioned substantially parallel to a surface such that the non-skid block contacts the surface to increase frictional resistance to translation of the cooler relative to the surface; and the cooler is configurable in a second orientation in which the angled portion is in contact with the surface to reduce frictional resistance to the translation of the cooler relative to the surface.

18. The cooler of claim 17, further comprising a fastener housing receiver that is defined in the bottom surface of the bottom portion, wherein:

the foot assembly defines a fastener housing that includes an elongated portion that protrudes substantially normal to the planar portion and that defines a fastener opening that is configured to receive a fastener; and the fastener housing receiver is sized such that an outer surface of the fastener housing contacts at least a portion of an inner surface of the fastener housing receiver when the fastener housing is received in the fastener housing receiver.

19. The cooler of claim 18, wherein:

the planar portion defines a block opening in which the non-skid block is retained;

the non-skid block includes an external portion that extends above the front surface of the planar portion when positioned in the block opening, and an inner block structure that is received in the block opening;

the block retainer includes an outer edge at least a portion of which is configured to be aligned with an outer edge of the bottom surface;

the block retainer includes one or more ribs that extend from the outer edge to the fastener housing and between the outer edge to an inner perimeter that extends around at least a portion of the block opening; and the interior surface of the planar portion is included on a surface of at least one of the ribs.

20. The cooler of claim 19, further comprising:

two handles;

a drain subassembly; and a clasp subassembly, wherein:

the exterior layer is a unitary one-piece blow-molded structure that includes the bottom portion, the side portions, a top surface, a front portion, and a rear portion;

the top surface includes a lip that extends substantially normal to an interior perimeter of the top surface;

the top surface defines a groove; and the interior layer includes a n-shaped channel that extends around at least a portion of a perimeter of the interior layer that extends over the lip and into the groove.

* * * * *